US009758275B2

(12) United States Patent
Fitzwater et al.

(10) Patent No.: US 9,758,275 B2
(45) Date of Patent: Sep. 12, 2017

(54) REINFORCED PACKAGE

(71) Applicant: Graphic Packaging International, Inc., Atlanta, GA (US)

(72) Inventors: Kelly R. Fitzwater, Lakewood, CO (US); Scott Thomas Strand, Lake Elmo, MN (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/496,252

(22) Filed: Sep. 25, 2014

(65) Prior Publication Data

US 2015/0083789 A1 Mar. 26, 2015

Related U.S. Application Data

(60) Provisional application No. 61/960,712, filed on Sep. 25, 2013.

(51) Int. Cl.
*B65D 5/60* (2006.01)
*B31B 1/62* (2006.01)
(Continued)

(52) U.S. Cl.
CPC ..... *B65D 5/606* (2013.01); *B31B 1/62* (2013.01); *B31B 1/78* (2013.01); *B31B 11/00* (2013.01); *B65D 5/103* (2013.01); *B65D 5/3628* (2013.01)

(58) Field of Classification Search
USPC ..... 229/117.34, 117.32, 117.05, 117.3, 229/117.27, 902, 904; 493/99, 100
See application file for complete search history.

(56) References Cited

U.S. PATENT DOCUMENTS 1,474,088 A 11/1923 Reynolds
1,516,090 A 11/1924 Gary et al.
(Continued)

FOREIGN PATENT DOCUMENTS

CA 2 384 311 3/2001
CA 2 586 472 5/2006
(Continued)

OTHER PUBLICATIONS

International Search Report and Written Opinion for PCT/US2016/043520 dated Oct. 28, 2016.
(Continued)

*Primary Examiner* — Christopher Demeree
(74) *Attorney, Agent, or Firm* — Womble Carlyle Sandridge & Rice, LLP

(57) ABSTRACT

A reinforced package for holding a product. The reinforced package comprises a carton comprising a plurality of panels that extend at least partially around an interior of the carton. The plurality of panels can comprise a front panel, a first side panel foldably connected to the front panel, a second side panel foldably connected to the front panel, at least one back panel foldably connected to at least one of the first side panel and the second side panel, and at least one bottom panel foldably connected to at least one of the front panel and the back panel. A bag can comprise an at least partially open end, an at least partially closed end, and an interior space for holding a product. The bag can be at least partially received in the interior of the carton. The carton is positionable in a non-erect position and in an erect position.

62 Claims, 20 Drawing Sheets

(51) Int. Cl.

| | |
|---|---|
| ***B65D 5/72*** | (2006.01) |
| ***B31B 11/00*** | (2006.01) |
| ***B31B 1/78*** | (2006.01) |
| ***B65D 5/10*** | (2006.01) |
| ***B65D 5/36*** | (2006.01) |

(56) References Cited

U.S. PATENT DOCUMENTS

| | | | |
|---|---|---|---|
| 1,664,111 | A | 3/1928 | Johnson |
| 2,092,858 | A | 9/1937 | Richard |
| 2,099,257 | A | 11/1937 | Bergstein |
| 2,107,946 | A | 2/1938 | Inman |
| 2,132,966 | A | 11/1938 | O'Brien |
| 2,166,388 | A | 7/1939 | Bergstein |
| 2,197,133 | A | 4/1940 | Piazze |
| 2,250,249 | A | 7/1941 | Bergstein |
| 2,282,207 | A | 5/1942 | Palmer |
| 2,286,465 | A | 6/1942 | Clerment |
| RE23,096 | E | 4/1949 | Mullinix |
| 2,553,923 | A | 5/1951 | Lambert |
| 2,835,435 | A | 5/1958 | Mullinix |
| 2,870,023 | A | 1/1959 | Vogt |
| 2,913,161 | A | 11/1959 | Travis |
| 2,987,402 | A | 6/1961 | Dold |
| 3,142,231 | A | 7/1964 | Christensson |
| 3,142,430 | A | 7/1964 | Meyers |
| 3,194,471 | A | 7/1965 | Murphy |
| 3,240,419 | A | 3/1966 | Spiering et al. |
| 3,249,286 | A | 5/1966 | Palmer |
| 3,250,454 | A | 5/1966 | Steiger |
| 3,272,423 | A | 9/1966 | Bjarno |
| 3,324,998 | A | 6/1967 | Farquhar |
| 3,357,631 | A | 12/1967 | Aid et al. |
| 3,399,818 | A | 9/1968 | Stegner |
| 3,428,235 | A | 2/1969 | Randazzo |
| 3,459,357 | A | 8/1969 | Egger et al. |
| 3,482,758 | A | 12/1969 | Pierre |
| 3,515,333 | A | 6/1970 | Kotkas et al. |
| 3,576,290 | A | 4/1971 | Marchisen |
| 3,627,541 | A | 12/1971 | Farquhar |
| 3,637,130 | A | 1/1972 | Farquhar |
| 3,659,777 | A | 5/1972 | Kanada et al. |
| 3,945,870 | A | 3/1976 | Johnsen |
| 3,964,669 | A | 6/1976 | Sontag et al. |
| 4,011,983 | A | 3/1977 | Greene |
| 4,082,216 | A | 4/1978 | Clarke |
| 4,196,035 | A | 4/1980 | Reil |
| 4,228,945 | A | 10/1980 | Wysocki |
| 4,267,955 | A | 5/1981 | Struble |
| 4,284,205 | A | 8/1981 | Hirata |
| 4,312,451 | A | 1/1982 | Forbes, Jr. |
| 4,313,542 | A | 2/1982 | Roberts et al. |
| 4,398,636 | A | 8/1983 | Baxter |
| 4,457,483 | A | 7/1984 | Gagne |
| 4,477,014 | A | 10/1984 | Brandenburger |
| 4,478,351 | A | 10/1984 | Homma |
| 4,484,683 | A | 11/1984 | Werner, Jr. |
| 4,494,785 | A | 1/1985 | Song |
| 4,575,000 | A | 3/1986 | Gordon et al. |
| 4,754,914 | A | 7/1988 | Wischusen, III |
| 4,775,771 | A | 10/1988 | Pawlowski |
| 4,785,696 | A | 11/1988 | Martiny |
| 4,865,921 | A | 9/1989 | Hollenberg |
| 4,890,439 | A | 1/1990 | Smart |
| 4,919,785 | A | 4/1990 | Willey et al. |
| 4,930,639 | A | 6/1990 | Rigby |
| 4,936,935 | A | 6/1990 | Beckett |
| 4,940,200 | A | 7/1990 | Sawyer |
| 4,963,424 | A | 10/1990 | Beckett |
| 5,028,147 | A | 7/1991 | Graham |
| 5,034,234 | A | 7/1991 | Andreas et al. |
| 5,071,062 | A | 12/1991 | Bradley et al. |
| 5,078,273 | A | 1/1992 | Kuchenbecker |
| 5,080,643 | A | 1/1992 | Mitchell et al. |
| 5,093,364 | A | 3/1992 | Richards |
| 5,096,723 | A | 3/1992 | Turpin |
| 5,117,078 | A | 5/1992 | Beckett |
| 5,132,124 | A | 7/1992 | Tamaki et al. |
| 5,175,404 | A | 12/1992 | Andreas et al. |
| 5,213,902 | A | 5/1993 | Beckett |
| 5,221,419 | A | 6/1993 | Beckett |
| 5,260,537 | A | 11/1993 | Beckett |
| 5,266,386 | A | 11/1993 | Beckett |
| 5,326,022 | A | 7/1994 | Green |
| 5,330,099 | A | 7/1994 | Beales et al. |
| RE34,683 | E | 8/1994 | Maynard |
| 5,337,951 | A | 8/1994 | Roccaforte |
| 5,340,436 | A | 8/1994 | Beckett |
| 5,346,311 | A | 9/1994 | Siler et al. |
| 5,354,973 | A | 10/1994 | Beckett |
| 5,410,135 | A | 4/1995 | Pollart |
| 5,411,165 | A | 5/1995 | Ellis |
| 5,424,517 | A | 6/1995 | Habeger |
| 5,427,267 | A | 6/1995 | Willman |
| 5,484,100 | A | 1/1996 | Rigby |
| 5,492,269 | A * | 2/1996 | Sung ..... B65D 5/3628 229/117.06 |
| 5,510,132 | A | 4/1996 | Gallo, Jr. |
| 5,519,195 | A | 5/1996 | Keefer |
| 5,585,027 | A | 12/1996 | Young |
| 5,615,795 | A | 4/1997 | Tipps |
| 5,628,921 | A | 5/1997 | Beckett |
| 5,672,407 | A | 9/1997 | Beckett |
| 5,688,427 | A | 11/1997 | Gallo, Jr. |
| 5,759,422 | A | 6/1998 | Schmelzer |
| 5,800,724 | A | 9/1998 | Habeger |
| 5,921,681 | A | 7/1999 | Money |
| 5,938,110 | A | 8/1999 | Bernstein |
| 5,964,161 | A | 10/1999 | Conway |
| 6,063,415 | A | 5/2000 | Walters |
| 6,082,613 | A | 7/2000 | Mikulski et al. |
| 6,114,679 | A | 9/2000 | Lai |
| 6,132,351 | A | 10/2000 | Lotto et al. |
| 6,139,662 | A | 10/2000 | Forman |
| 6,150,646 | A | 11/2000 | Lai et al. |
| 6,204,492 | B1 | 3/2001 | Zeng et al. |
| 6,234,384 | B1 | 5/2001 | Capy et al. |
| 6,251,451 | B1 | 6/2001 | Zeng |
| 6,254,519 | B1 | 7/2001 | Toshima |
| 6,335,042 | B1 | 1/2002 | Money |
| 6,349,874 | B1 | 2/2002 | Hill |
| 6,360,941 | B1 | 3/2002 | Larsson |
| 6,401,927 | B1 | 6/2002 | Sorensen et al. |
| 6,414,290 | B1 | 7/2002 | Cole |
| 6,431,365 | B1 | 8/2002 | Money |
| 6,433,322 | B2 | 8/2002 | Zeng et al. |
| 6,455,827 | B2 | 9/2002 | Zeng |
| 6,494,619 | B1 | 12/2002 | Sulpizio |
| 6,552,315 | B2 | 4/2003 | Zeng et al. |
| 6,637,646 | B1 | 10/2003 | Muise et al. |
| 6,677,563 | B2 | 1/2004 | Lai |
| 6,683,289 | B2 | 1/2004 | Whitmore et al. |
| 6,695,202 | B2 | 2/2004 | Miess |
| 6,702,178 | B2 | 3/2004 | Bowers et al. |
| 6,717,121 | B2 | 4/2004 | Zeng |
| 6,744,028 | B2 | 6/2004 | Chisholm et al. |
| 6,765,182 | B2 | 7/2004 | Cole |
| 6,869,387 | B2 | 3/2005 | Post et al. |
| 6,986,920 | B2 | 1/2006 | Forman et al. |
| 7,019,271 | B2 | 3/2006 | Wnek et al. |
| 7,143,930 | B2 | 12/2006 | Money et al. |
| 7,414,230 | B2 | 8/2008 | Fitzwater |
| 7,473,875 | B2 | 1/2009 | Fitzwater |
| 7,510,515 | B2 | 3/2009 | Ichikawa |
| 7,604,155 | B2 | 10/2009 | Bossel et al. |
| 7,667,167 | B2 | 2/2010 | Fitzwater |
| 7,699,214 | B2 | 4/2010 | Mestre et al. |
| 7,819,583 | B2 | 10/2010 | Walker et al. |
| 7,837,606 | B2 | 11/2010 | Tetenborg et al. |
| 7,893,389 | B2 | 2/2011 | Fitzwater |
| 7,913,897 | B2 | 3/2011 | Manaige |
| 7,938,312 | B2 | 5/2011 | Ford |
| 7,959,060 | B2 | 6/2011 | Wilson et al. |
| 7,982,167 | B2 | 7/2011 | Fitzwater |

(56) References Cited

U.S. PATENT DOCUMENTS

| | | | | |
|---|---|---|---|---|
| 7,984,844 | B2 | 7/2011 | Jones | |
| 8,013,280 | B2 | 9/2011 | Robison et al. | |
| 8,066,137 | B2 | 11/2011 | Sanfilippo et al. | |
| 8,142,077 | B2 | 3/2012 | Iannelli, II et al. | |
| 8,196,805 | B2 | 6/2012 | Brand et al. | |
| 8,206,033 | B2 | 6/2012 | Sato et al. | |
| 8,226,794 | B2 | 7/2012 | Fogle | |
| 8,309,896 | B2 | 11/2012 | Fitzwater | |
| 8,317,671 | B1 | 11/2012 | Zoeckler | |
| 8,403,819 | B2 | 3/2013 | Zoeckler | |
| 8,403,820 | B2 | 3/2013 | Zoeckler | |
| 8,468,782 | B2 | 6/2013 | Michalsky et al. | |
| 8,474,163 | B2 | 7/2013 | Rubin | |
| 8,500,330 | B2 | 8/2013 | Nomura et al. | |
| 8,672,214 | B2 | 3/2014 | Manaige | |
| 8,727,204 | B2 | 5/2014 | Burke | |
| 9,108,761 | B2 | 8/2015 | Fitzwater et al. | |
| 9,113,648 | B2 | 8/2015 | Burke | |
| 9,156,579 | B2 | 10/2015 | Pinkstone | |
| 9,156,582 | B2 | 10/2015 | Walsh et al. | |
| 9,346,234 | B2 | 5/2016 | Hajek et al. | |
| 9,346,582 | B2 | 5/2016 | Pinkstone | |
| 9,463,896 | B2 | 10/2016 | Fitzwater | |
| 2003/0002755 | A1* | 1/2003 | Kim et al. | 383/119 |
| 2003/0080120 | A1 | 5/2003 | Whitmore et al. | |
| 2003/0185948 | A1 | 10/2003 | Garwood | |
| 2003/0206997 | A1 | 11/2003 | Winkelman et al. | |
| 2004/0004111 | A1 | 1/2004 | Cardinale | |
| 2004/0101605 | A1 | 5/2004 | Sigel | |
| 2005/0284865 | A1 | 12/2005 | Fogle et al. | |
| 2006/0009339 | A1 | 1/2006 | Sleight et al. | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2006/0191929 | A1 | 8/2006 | Berg, Jr. et al. | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0137222 | A1 | 6/2007 | Kastanek et al. | |
| 2007/0138247 | A1 | 6/2007 | Fitzwater | |
| 2007/0151888 | A1 | 7/2007 | Bossel et al. | |
| 2007/0267466 | A1 | 11/2007 | Brand et al. | |
| 2008/0308614 | A1 | 12/2008 | Fitzwater | |
| 2009/0039077 | A1 | 2/2009 | Fitzwater | |
| 2009/0214142 | A1 | 8/2009 | Bossel et al. | |
| 2010/0046861 | A1 | 2/2010 | Wilcoxen | |
| 2010/0263332 | A1 | 10/2010 | Files et al. | |
| 2011/0017812 | A1* | 1/2011 | Belko et al. | 229/117.27 |
| 2011/0019942 | A1* | 1/2011 | Piraneo | B31B 21/00 383/104 |
| 2011/0052106 | A1 | 3/2011 | Holmes et al. | |
| 2011/0297680 | A1* | 12/2011 | Howell et al. | 220/266 |
| 2012/0224794 | A1 | 9/2012 | Veder | |
| 2013/0068653 | A1 | 3/2013 | Lipinski | |
| 2014/0016882 | A1 | 1/2014 | Fitzwater | |
| 2015/0083789 | A1 | 3/2015 | Fitzwater et al. | |

FOREIGN PATENT DOCUMENTS

| | | | |
|---|---|---|---|
| DE | 1 060 313 | | 6/1959 |
| DE | 203 00 817 | | 4/2003 |
| EP | 1 072 526 | | 1/2001 |
| EP | 1 424 290 | A2 | 6/2004 |
| EP | 1 452 458 | | 9/2004 |
| EP | 1 457 425 | | 9/2004 |
| EP | 1 798 159 | A1 | 6/2007 |
| EP | 1 964 785 | | 9/2008 |
| EP | 2 492 203 | A1 | 8/2012 |
| EP | 2 492 204 | A1 | 8/2012 |
| FR | 2 516 481 | | 5/1983 |
| FR | 2 665 882 | | 2/1992 |
| FR | 2 687 384 | | 8/1993 |
| GB | 2 365 000 | | 2/2002 |
| JP | 2004 224402 | | 8/2004 |
| JP | 2005-320022 | A | 11/2005 |
| JP | 2006-240671 | A | 9/2006 |
| JP | 2010-222050 | A | 10/2010 |
| JP | 2011-168330 | A | 9/2011 |
| JP | 2011-168331 | A | 9/2011 |
| JP | 2011-173640 | A | 9/2011 |
| JP | 2011-189978 | A | 9/2011 |
| JP | 2011-251774 | A | 12/2011 |
| JP | 2012-152901 | | 8/2012 |
| JP | 2012-533487 | | 12/2012 |
| WO | WO 2006/052326 | | 5/2006 |
| WO | WO 2007/067705 | | 6/2007 |
| WO | WO 2007/084525 | A2 | 7/2007 |
| WO | WO 2008/086277 | A2 | 7/2008 |
| WO | WO 2009/023286 | | 2/2009 |
| WO | WO 2011/011283 | A2 | 1/2011 |
| WO | WO 2013/003149 | A | 1/2013 |

OTHER PUBLICATIONS

Supplementary Partial European Search Report for EP 14 84 9557 dated Mar. 7, 2017.

International Search Report and Written Opinion for PCT/US2016/047521 dated Dec. 13, 2016.

International Search Report and Written Opinion for PCT/US2014/057385 dated Jan. 30, 2015.

Supplementary European Search Report for EP 14 84 9557 dated Jun. 7, 2017.

* cited by examiner

REINFORCED PACKAGE

CROSS-REFERENCE TO RELATED APPLICATIONS

This application claims the benefit of U.S. Provisional Patent Application No. 61/960,712, filed Sep. 25, 2013.

INCORPORATION BY REFERENCE

The disclosure of U.S. Provisional Patent Application No. 61/960,712, which was filed on Sep. 25, 2013, is hereby incorporated by reference for all purposes as if presented herein in its entirety.

BACKGROUND OF THE DISCLOSURE

The present disclosure generally relates to packages for holding products. More specifically, the present disclosure is directed to packages having a reinforcing carton for supporting a bag.

SUMMARY OF THE DISCLOSURE

In one aspect, the present disclosure is generally directed to a reinforced package for holding a product. The reinforced package can comprise a carton comprising a plurality of panels that extend at least partially around an interior of the carton. The plurality of panels can comprise a front panel, a first side panel foldably connected to the front panel, a second side panel foldably connected to the front panel, at least one back panel foldably connected to at least one of the first side panel and the second side panel, and at least one bottom panel foldably connected to at least one of the front panel and the back panel. A bag can comprise an at least partially open end, an at least partially closed end, and an interior space for holding a product. The bag can be at least partially received in the interior of the carton. The carton is positionable in a non-erect position wherein the interior space of the bag is at least partially collapsed and in an erect position wherein the interior space of the bag is increased. The carton can be configured to support the bag in the erect position.

In another aspect, the disclosure is generally directed to a reinforcing carton for holding a product. The reinforcing carton can comprise a plurality of panels that extend at least partially around an interior of the carton. The plurality of panels can comprise a front panel, a first side panel foldably connected to the front panel, a second side panel foldably connected to the font panel, at least one back panel foldably connected to at least one of the first side panel and the second side panel, and at least one bottom panel foldably connected to at least one of the front panel and the back panel. Locking features can be in at least one panel of the plurality of panels. The locking features can be operable to at least partially retain the reinforcing carton in an erect position and to allow the plurality of panels to at least partially collapse into an non-erect position of the reinforcing carton.

In another aspect, the disclosure is generally directed to, in combination, a carton blank and a bag for forming a reinforced package for holding a product. The carton blank can comprise a plurality of panels comprising a front panel, a first side panel foldably connected to the front panel, a second side panel foldably connected to the front panel, at least one back panel foldably connected to at least one of the first side panel and the second side panel, and at least one bottom panel foldably connected to at least one of the front panel and the back panel. The bag can comprise an at least partially open end, an at least partially closed end, and an interior space for holding a product. The bag can be at least partially attached to the carton blank. The reinforced package formed from the carton blank and the bag is positionable in a non-erect position wherein the interior space of the bag is at least partially collapsed and in an erect position wherein the interior space of the bag is increased.

In another aspect, the disclosure is generally directed to a method for forming a reinforced package for holding a product. The method can comprise obtaining a carton blank comprising a plurality of panels comprising a front panel, a first side panel foldably connected to the front panel, a second side panel foldably connected to the front panel, at least one back panel foldably connected to at least one of the first side panel and the second side panel, and at least one bottom panel foldably connected to at least one of the front panel and the back panel. The method also can comprise obtaining a liner blank, forming a bag from the liner blank so that the bag comprises an at least partially open end, an at least partially closed end, and an interior space for holding a product, attaching at least a portion of the bag to at least one of the front panel and the back panel of the carton blank, and forming an interior of a carton at least partially defined by the plurality of panels. The forming the interior of the carton can comprise forming an open-ended sleeve. The carton can be positionable in a non-erect position wherein the interior space of the bag is at least partially collapsed and in an erect position wherein the interior space of the bag is increased. The carton can be configured to support the bag in the erect position.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons and packages for holding products or articles such as food products or other articles. Packages according to the present disclosure can accommodate articles of any shape. For purpose of illustration and not for the purpose of limiting the scope of the disclosure, the terms "lower", "bottom", "upper", "top", "front", and "back" indicate orientations determined in relation to erected cartons.

Figure 1:
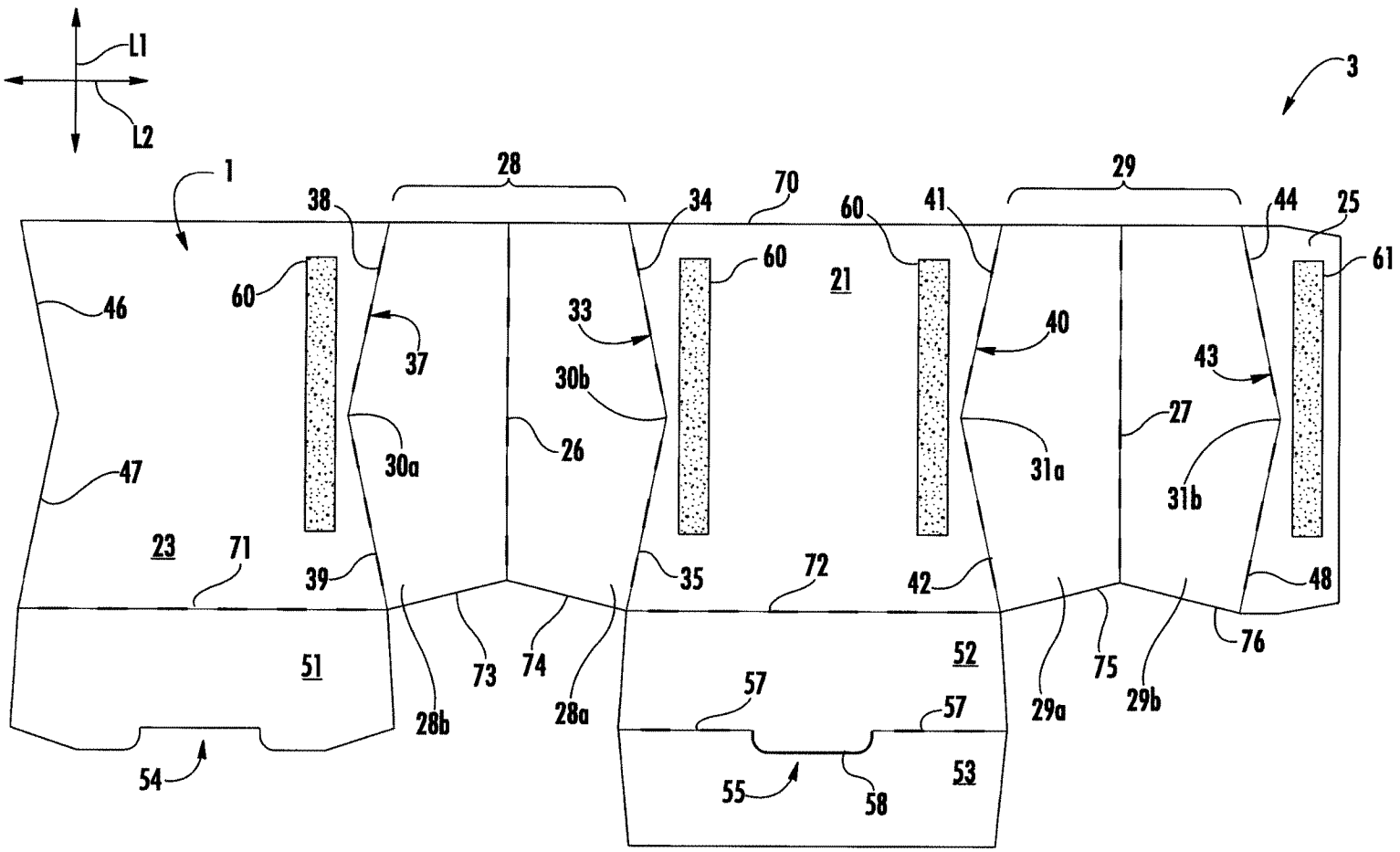
FIG. 1 is a plan view of an interior surface of a carton blank for forming a reinforcing carton of a reinforced package according to an exemplary embodiment of the disclosure.
Figure 14:
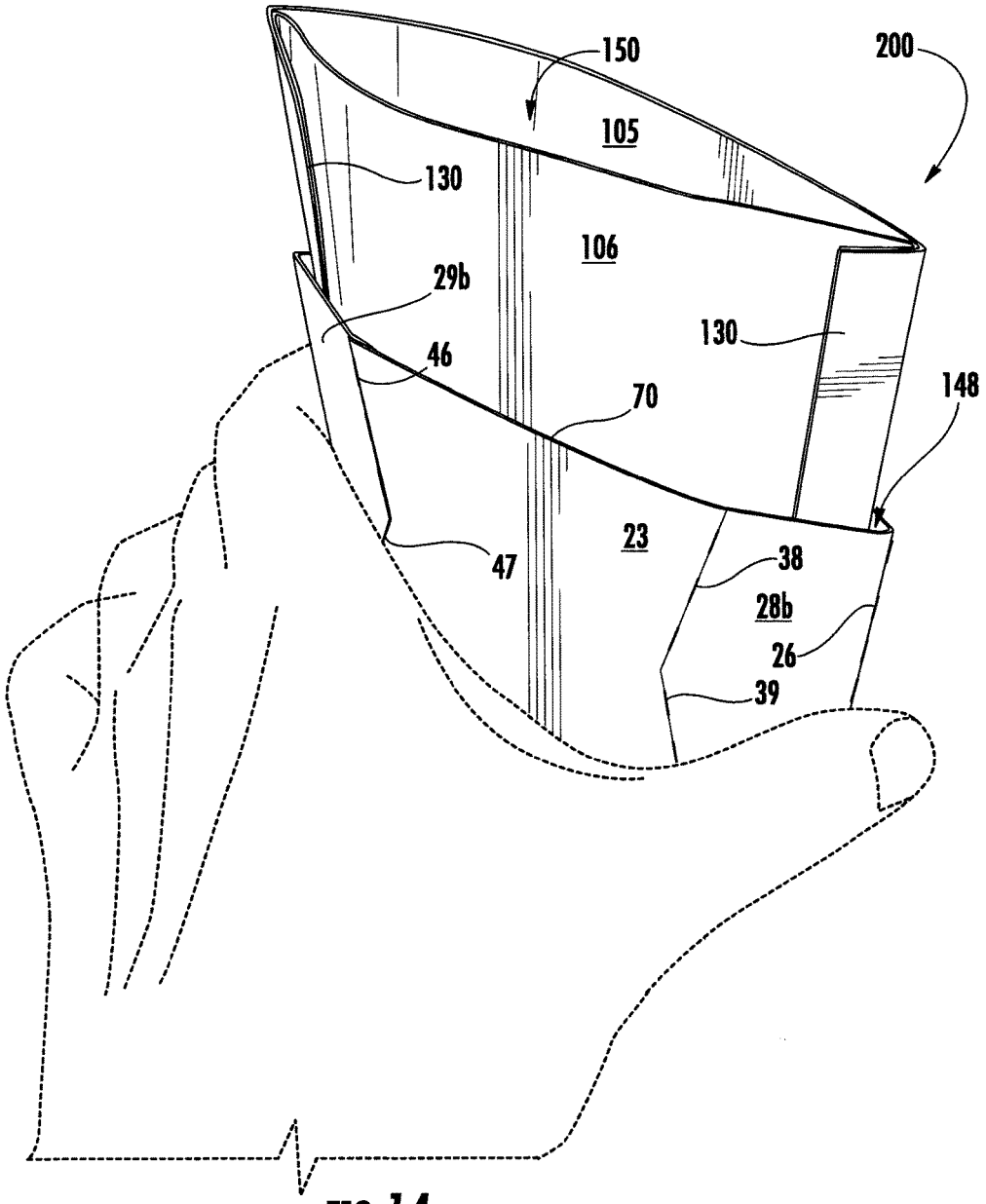
FIGS. 14-16 illustrate a transition of the reinforced package from the non-erected position to an erected position according to the exemplary embodiment of the disclosure.
Figure 15:
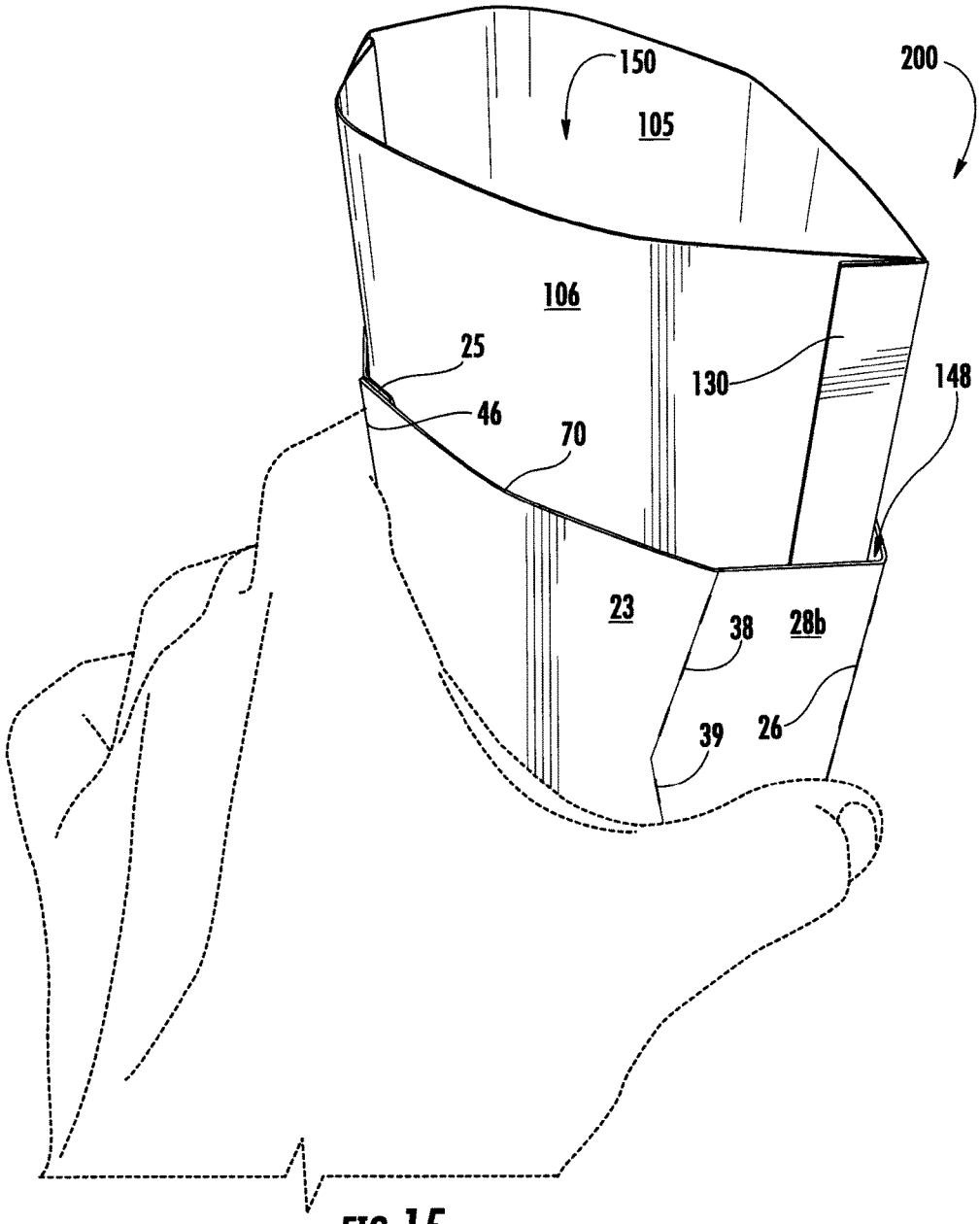
Figure 16:
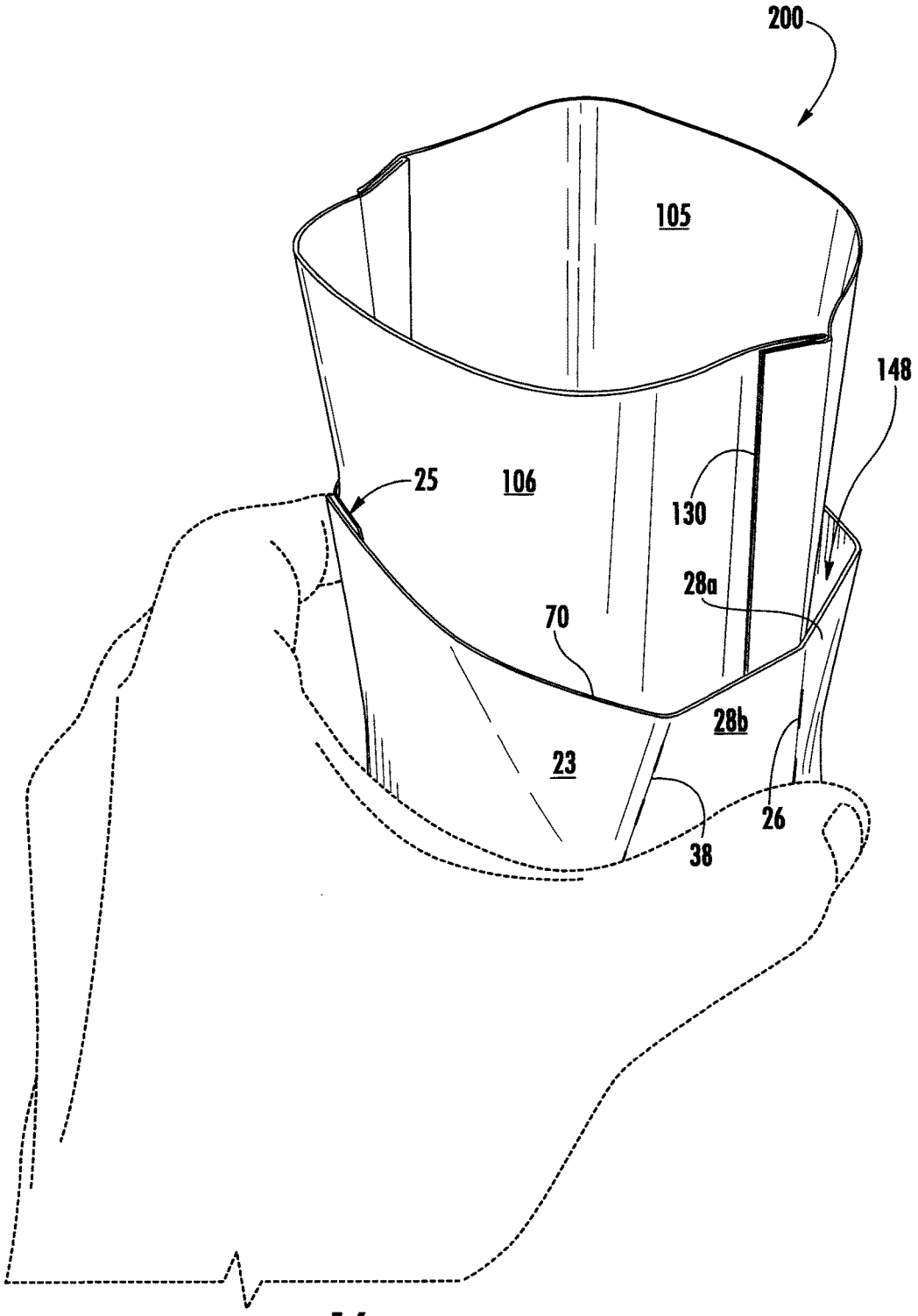

FIG. 1 is a plan view of an interior surface 1 of a carton blank 3 for forming a reinforcing carton 5 (FIG. 5) for holding a bag 6 or liner in a reinforced package 200 (FIG. 14), according to an embodiment of the disclosure. The carton blank 3 has a lateral axis L1 and a longitudinal axis L2. In the illustrated embodiment, the carton blank 3 has a front panel 21 foldably connected to a first side panel 28 at a first fold line 33, a back panel 23 foldably connected to the first side panel 28 at a second fold line 37, and a second side panel 29 foldably connected to the front panel 21 at a third fold line 40. As shown in FIG. 1, an attachment flap 25 is foldably connected to the second side panel 29 at a fourth fold line 43.

As shown in FIG. 1, the first side panel 28 includes two individual panel portions 28*a*, 28*b* foldably connected to one another along a lateral fold line 26. Similarly, the second side panel 29 includes two individual panel portions 29*a*, 29*b* foldably connected to one another along a lateral fold line 27.

In the illustrated embodiment, the first fold line 33 is segmented into two oblique fold line segments 34, 35 extending from a vertex 30*a*. The second fold line 37 is segmented into two oblique fold line segments 38, 39 extending from a vertex 30*b*. The third fold line 40 is segmented into two oblique fold line segments 41, 42 extending from a vertex 31*a*. The fourth fold line 43 is segmented into two oblique fold line segments 44, 45 extending from a vertex 31*b*. The fold lines 33, 37 can be spaced apart from lateral fold line 26 so that the vertices 30*a*, 30*b* are spaced apart from the lateral fold line 26 farther than the opposite ends of the oblique fold line segments 34, 35, 38, 39 (e.g., the panel portions 28*a*, 28*b* and the first side panel 28 are widest between or adjacent the vertices 30*a*, 30*b*). Similarly, the fold lines 40, 43 are spaced apart from lateral fold line 27 so that the vertices 31*a*, 31*b* are spaced apart from the lateral fold line 27 farther than the opposite ends of the oblique fold line segments 41, 42, 44, 48 (e.g., the panel portions 29*a*, 29*b* and the first side panel 29 are widest between or adjacent the vertices 31*a*, 31*b*). The fold lines 33, 37, 40, 43 could be omitted or could be otherwise arranged, shaped, positioned, and/or configured without departing from the disclosure. For example, the fold lines could be arcuate fold lines rather than segmented fold lines as shown.

As shown in FIG. 1, the blank 3 further can include a first bottom panel 51 foldably connected to the back panel 23 at longitudinal fold line 71 and a second bottom panel 52 foldably connected to the front panel 21 at longitudinal fold line 72. As illustrated, a bottom end flap 53 is foldably connected to the second bottom panel 52 at fold lines 57. A locking tab 55 extends from the second bottom panel 52 and is separable from the bottom end flap 53 along a cut 58. Furthermore, a complementary locking notch or recess 54 is formed in the first bottom panel 51 and defines an edge of the first bottom panel 51 for engaging the locking tab 55. The locking notch 54 is sized or dimensioned to engage the locking tab 55.

In the illustrated embodiment, the blank 3 includes adhesive regions 60 on the back panel 23, and front panel 21, for receiving adhesive and being fixedly attached to an exterior surface of the bag 6. Additionally, the blank 3 can include an adhesive region 61 on the attachment flap 25 for receiving adhesive and being fixedly attached to an interior surface of the back panel 23. The adhesive regions 60, 61 could be omitted or could be otherwise arranged, shaped, positioned, and/or configured without departing from the disclosure.

As shown in FIG. 1, the carton blank 3 has a first edge 70 (e.g. free edge) generally extending in the longitudinal direction L2. The blank 3 further includes oblique edges 73, 74, 75, and 76 (e.g. free edges) arranged opposite the first edge 70. Accordingly, the edges 73, 74, 75, 76 form lower free edges of the respective panel portions 28*b*, 28*a*, 29*a*, 29*b*. The edges 70, 73, 74, 75, 76 could be omitted or could be otherwise arranged, shaped, positioned, and/or configured without departing from the disclosure.

In the illustrated embodiment, the carton blank 3 and carton 5 can comprise any material which is relatively rigid such as paperboard, clay-coated paperboard, solid bleached board (SBB) paperboard, solid bleached sulphate (SBS) paperboard, Kraft line paperboard, or any other suitable material without departing from the disclosure. In alternative embodiments, the carton blank 3 could be otherwise shaped and could have alternative panel, flap, fold line, and/or panel portion arrangements.

Figure 2:
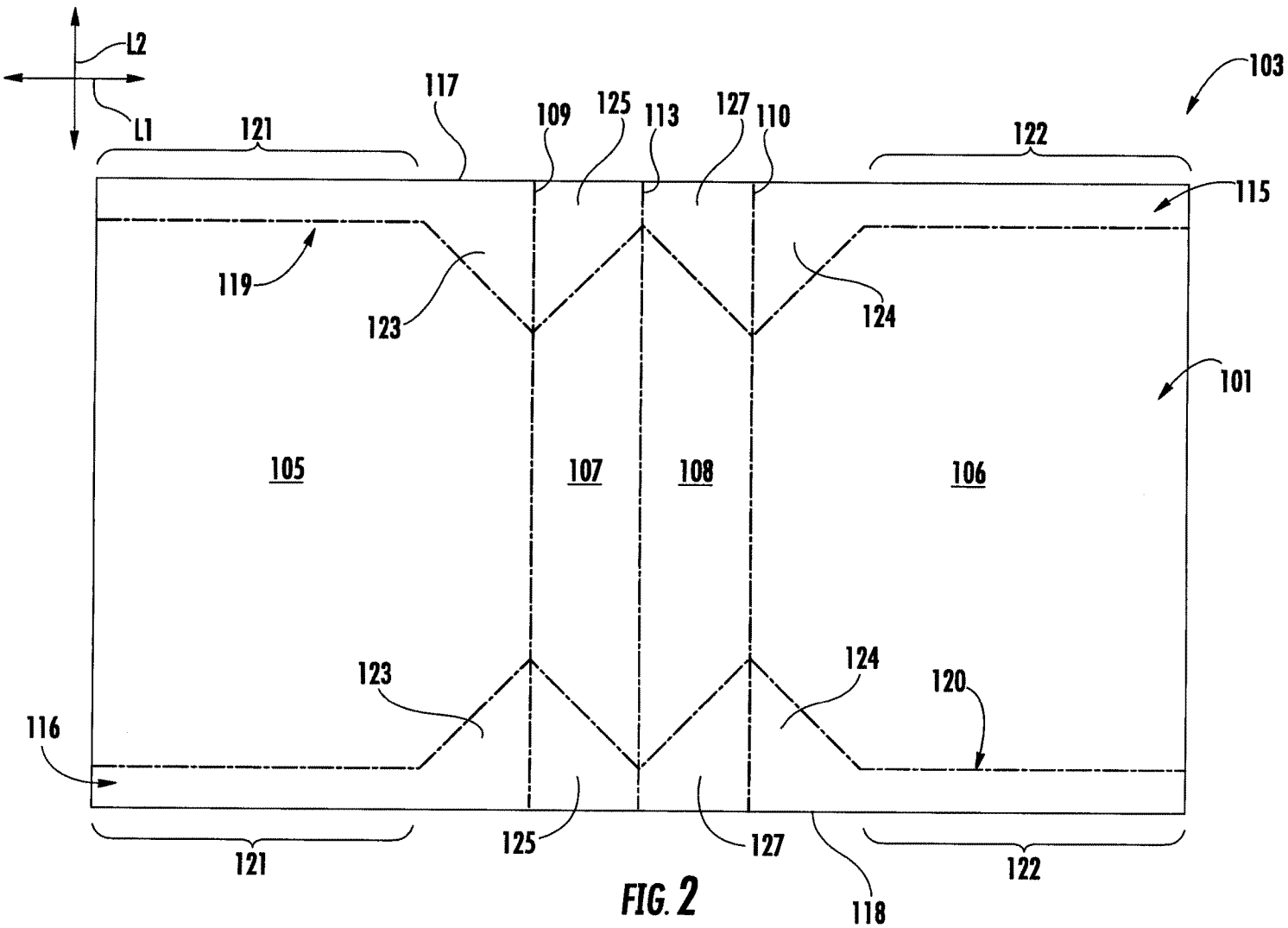
FIG. 2 is a plan view of an interior surface of a liner blank for forming a bag of the reinforced package according to the exemplary embodiment of the disclosure.

Turning to FIG. 2, a plan view of an interior surface 101 of an insert blank 103 or portion of liner material for forming a bag 6 (FIG. 6) of the reinforced package 200 (FIG. 12) is illustrated. As illustrated in FIG. 2, the lateral axis L1 and the longitudinal axis L2 of the liner blank 103 are oriented so that the lateral axis L1 and the longitudinal axis L2 of the liner blank 103 comport with the respective lateral axis L1 and longitudinal axis L2 of the carton blank 3 established in FIG. 1. The liner blank 103 or liner material may be formed of generally non-permeable material or layers of material, such that a formed bag 6 may hold liquid. The liner blank 103 can comprise any suitable material which is relatively flexible and relatively fluid impervious. The liner blank 103 can comprise plastics such as polyethylene, polypropylene, polyethylene terephthalate, polystyrene, poly vinyl chloride, or any other suitable material without departing from the disclosure. Alternatively, the liner blank 103 could comprise a fluid pervious material without departing from the disclosure.

As shown in FIG. 2, the liner blank 103 may include sidewalls 105, 106 foldably connected to gusset panels 107, 108 at fold lines 109, 110, respectively. The gusset panels 107, 108 may be foldably connected to one another at fold line 113. The liner blank 103 may include glue areas 115, 116 extending along respective marginal areas of the blank and at least partially defined between a respective laterally-extending edge 117, 118 and a respective line 119, 120. In one embodiment, the lines 119, 120 only schematically indicate the inner periphery of the glue areas 115, 116. In an alternative embodiment, the lines 119, 120 are drawn on and/or formed in the liner blank 103. For example, guide lines may be drawn on the liner blank 103 and/or creases may be formed in the liner blank 103. Each of the glue areas 115, 116 can include sealing regions 121, 122 at opposite ends of the respective sidewalls 105, 106 along lateral portions of the lines 119, 120 and sealing corner portions 123, 124 at opposite ends of the respective sidewalls 105, 106 adjacent oblique portions of the respective lines 119, 120 and adjacent the respective fold lines 109, 110. Additionally, the glue areas 115, 116 can include respective sealing corner portions 125 at opposite ends of the gusset panel 107 between fold lines 109, 113 and adjacent an oblique portion of the respective lines 119, 120 and respective sealing corner portions 127 at opposite ends of the gusset panel 108 between fold lines 110, 113 and adjacent an oblique portion of the respective lines 119, 120. The sidewalls 105, 106, the gusset panels 107, 108, and/or the glue areas 115, 116 could be omitted or could be otherwise arranged, shaped, positioned, or configured without departing from the disclosure.

Figure 3:
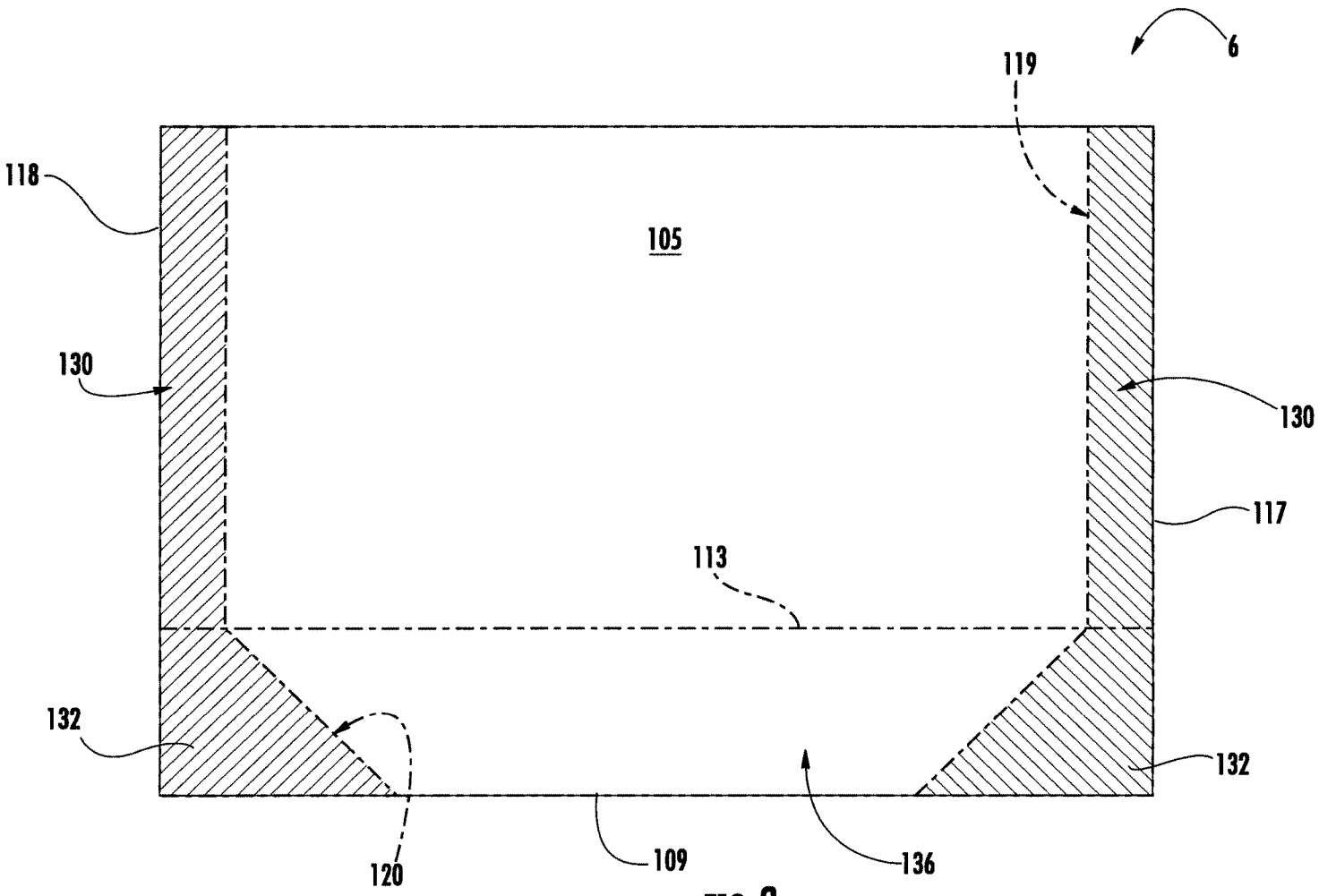
FIG. 3 is a front view of the bag formed from the liner blank of FIG. 2.

The bag 6 can be formed, in one exemplary embodiment, as shown in FIG. 3. Accordingly, the liner blank 103 can be folded along the fold lines 113, 109, 110 so that the gusset panels 107, 108 are at least partially in face-to-face contact with one another and with the respective sidewalls 105, 106. Additionally, the sidewalls 105, 106 are disposed at least partially in face-to-face contact with one another above the gusset panels 107, 108. Glue can be applied to at least a portion of each of the glue areas 115, 116 (e.g., the shaded regions in FIG. 3) on the interior surface 101 of the liner blank 103 before, after, and/or during folding along the fold lines 109, 110, 113. Accordingly, when the sealing regions 121 of the sidewall 105 are disposed in face-to-face contact with the respective sealing regions 122 of the sidewall 106, the sealing regions are glued together to at least partially form a seam 130 at each end of the bag 6 (FIG. 3). Additionally, each of the sealing corner portions 123 of the sidewall 105 is glued to the respective sealing corner portions 125 of the gusset panel 107 and each of the sealing corner portions 124 of the sidewall 106 is glued to the respective sealing corner portion 127 of the gusset panel 108 to form two sealed corners 132 at the bottom ends of each of the seams 130. The bag 6 could be formed from the liner blank 103 by alternative steps without departing from the disclosure.

In one embodiment, the portions of the sidewalls 105, 106 and the gusset panels 107, 108 outside the glue areas 115, 116 remain generally free of glue so that the sidewalls and gusset panels generally are not glued together outside the glue areas. Accordingly, the bag 6 can be expanded to open up an interior space of the bag by moving the sidewalls 105, 106 apart from one another and by folding the gusset panels 107, 108 along fold lines 109, 110, 113 so that the gusset panels 107, 108 are generally coplanar and extend between the spaced-apart sidewalls 105, 106. The seams 130 and the sealed corners 132 can form closed ends or sides of the bag 6, and the gusset panels 107, 108 and the sealed corners 132 can form a closed bottom 136 of the bag 6 while the bag is in either the collapsed configuration (e.g., FIG. 3) or the opened configuration (e.g., FIG. 17). The bag 6 can be positioned from the opened configuration to the closed configuration by folding the gusset panels 107, 108 inwardly along the fold lines 109, 110, 113 so that the fold line 113 and the gusset panels 107, 108 are disposed between the sidewalls 105, 106. The bag 6 could be positioned or moved between the collapsed configuration and the opened configuration by alternative steps without departing from the disclosure.

Figure 4:
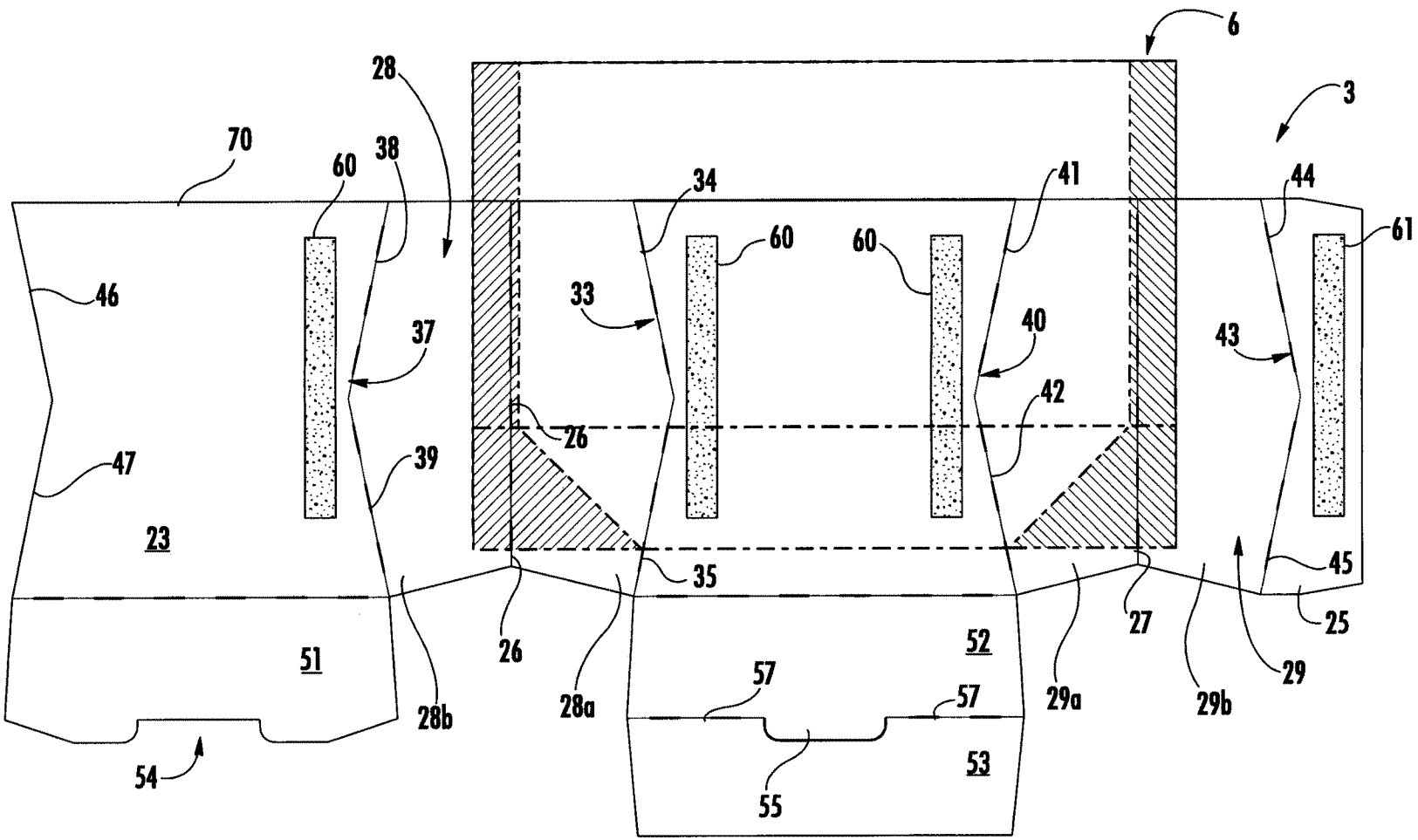
FIG. 4 is a plan view of the bag of FIG. 3 positioned relative to the blank of FIG. 1.
Figure 5:
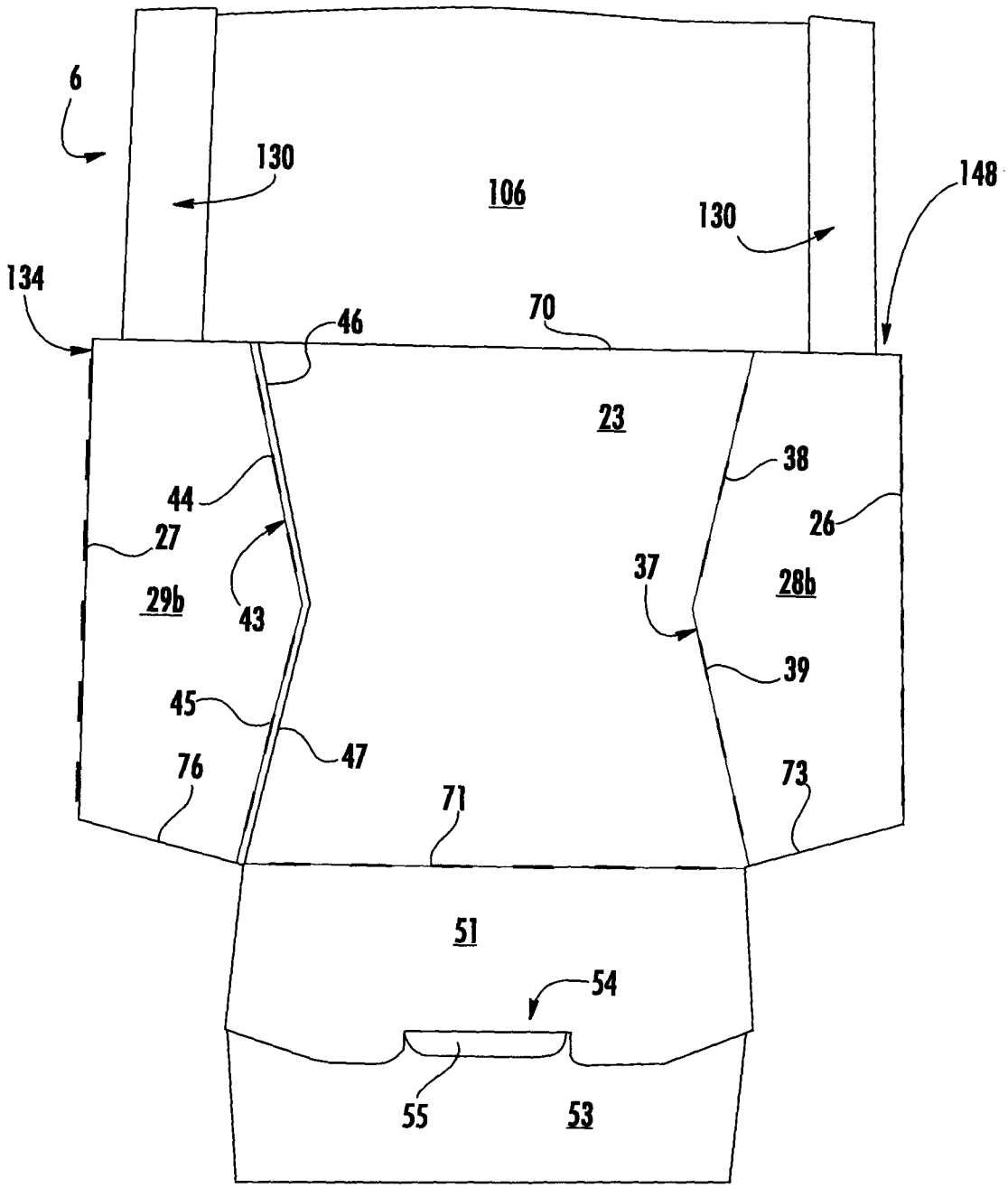
FIGS. 5 and 6 are views showing a partially-formed carton with the bag received therein according to the exemplary embodiment of the disclosure.
Figure 6:
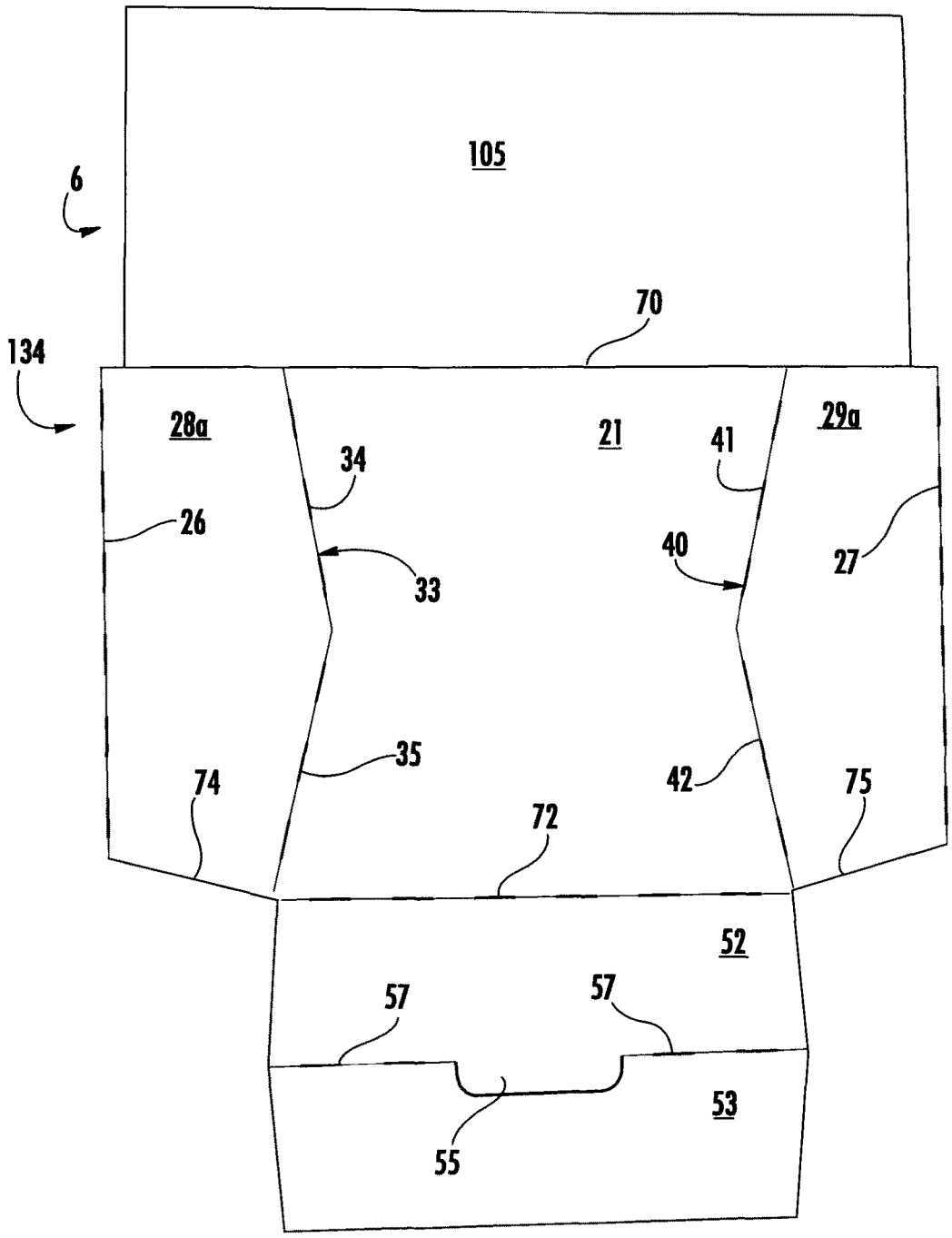

Generally, the carton blank 3 may be folded about fold lines 26, 27 to form an open-ended sleeve 134 (e.g., a reinforcing sleeve formation). For example, referring to FIGS. 4-6, the bag 6 can be aligned with the carton blank 3 (FIG. 4) and distal oblique edges 46, 47 of the back panel 23 may be overlapped and/or brought into registration with fold line segments 44, 45 (FIG. 5) such that the back panel 23 at least partially overlaps the attachment flap 25 and adhesive region 61 to form the open-ended sleeve 134 (FIGS. 5 and 6). Accordingly, the back panel 23 can be glued to the attachment flap 25 by the adhesive region 61. During this sequence, the reinforcing sleeve 134 can be attached (e.g., glued) to the bag 6 through adhesive regions 60. For example, the sidewalls 105, 106 can be glued to the respective front panel 21 and back panel 23 at adhesive regions 60. Further, the seams 130 and the outer portions of the sealed corners 132 of the bag 6 may be folded to rest against the sidewall 106 as illustrated in FIG. 5. Alternatively, the seams 130 and the outer portions of the sealed corners 132 of the bag 6 may be folded to rest against the sidewall 105. The bag 6 could be otherwise attached to the carton blank 3/carton 5 without departing from the disclosure. For example, the either of the sidewalls 105, 106 could be glued to either of the front panel 21 and/or back panel 23 prior to folding the carton blank 3 or during or after formation of the carton 5.

Figure 7:
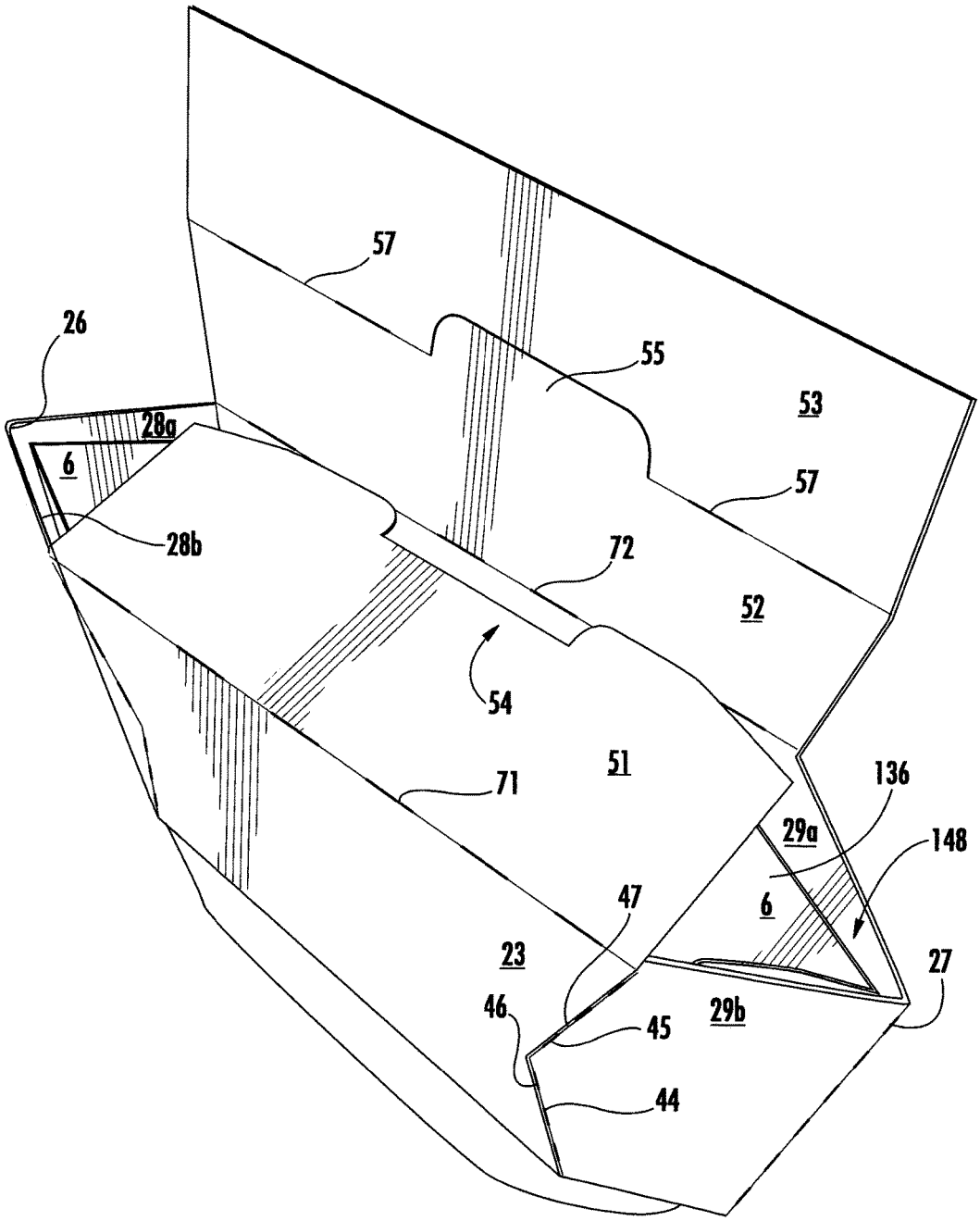
FIGS. 7-10 are bottom perspective views of the partially-formed carton of FIGS. 5 and 6 showing the formation of a closed bottom of the carton according to the exemplary embodiment of the disclosure.
Figure 8:
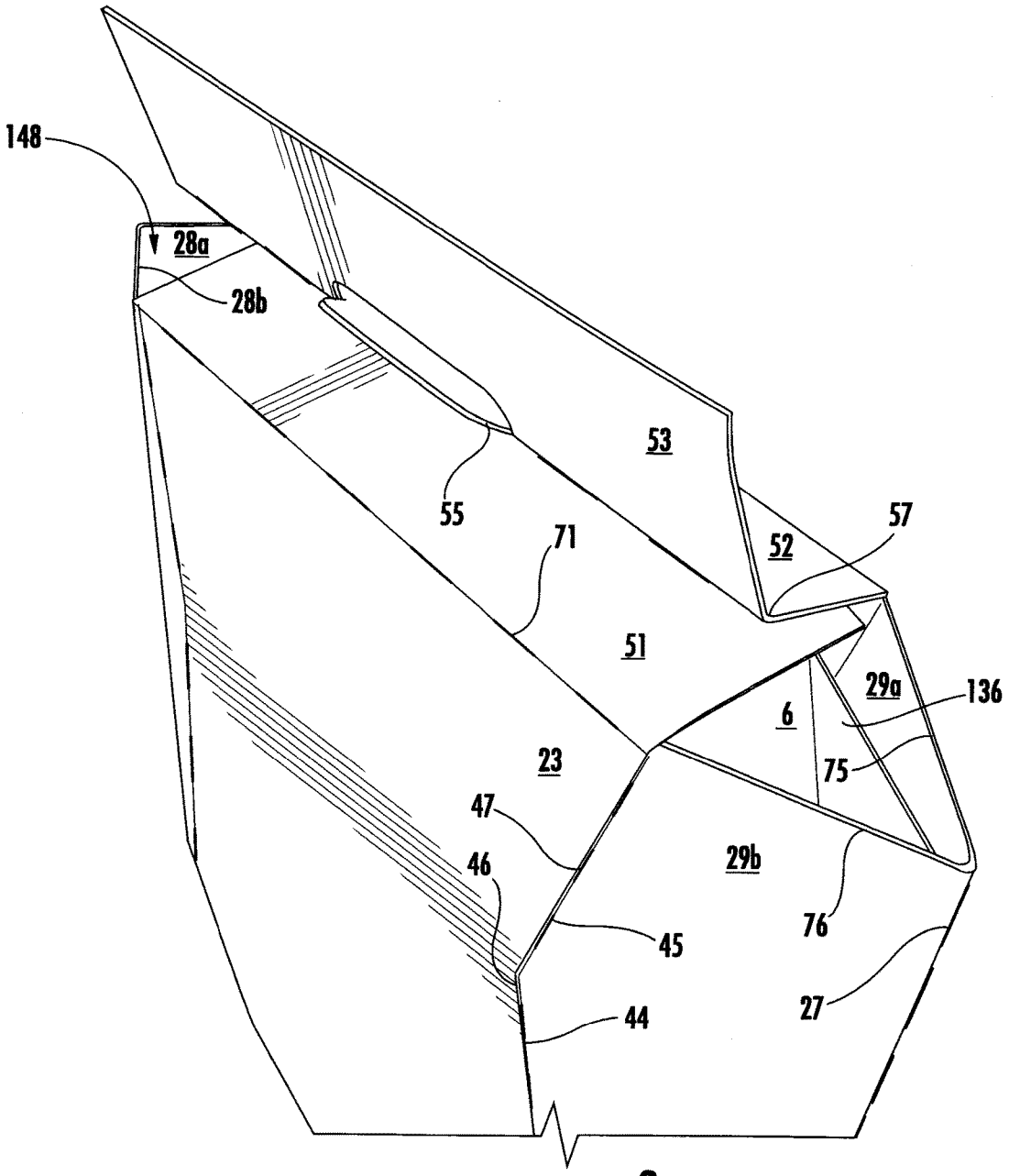
Figure 9:
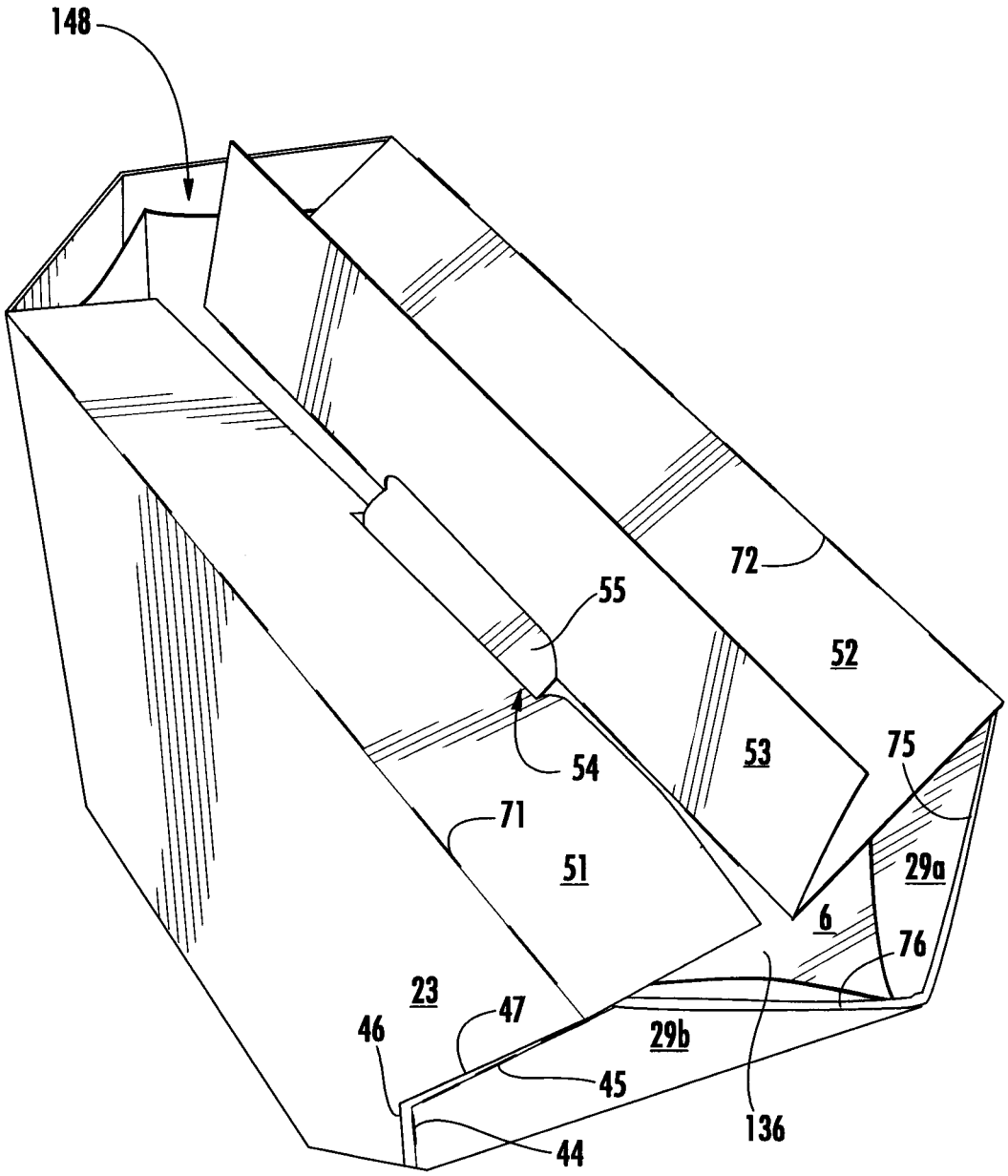
Figure 10:
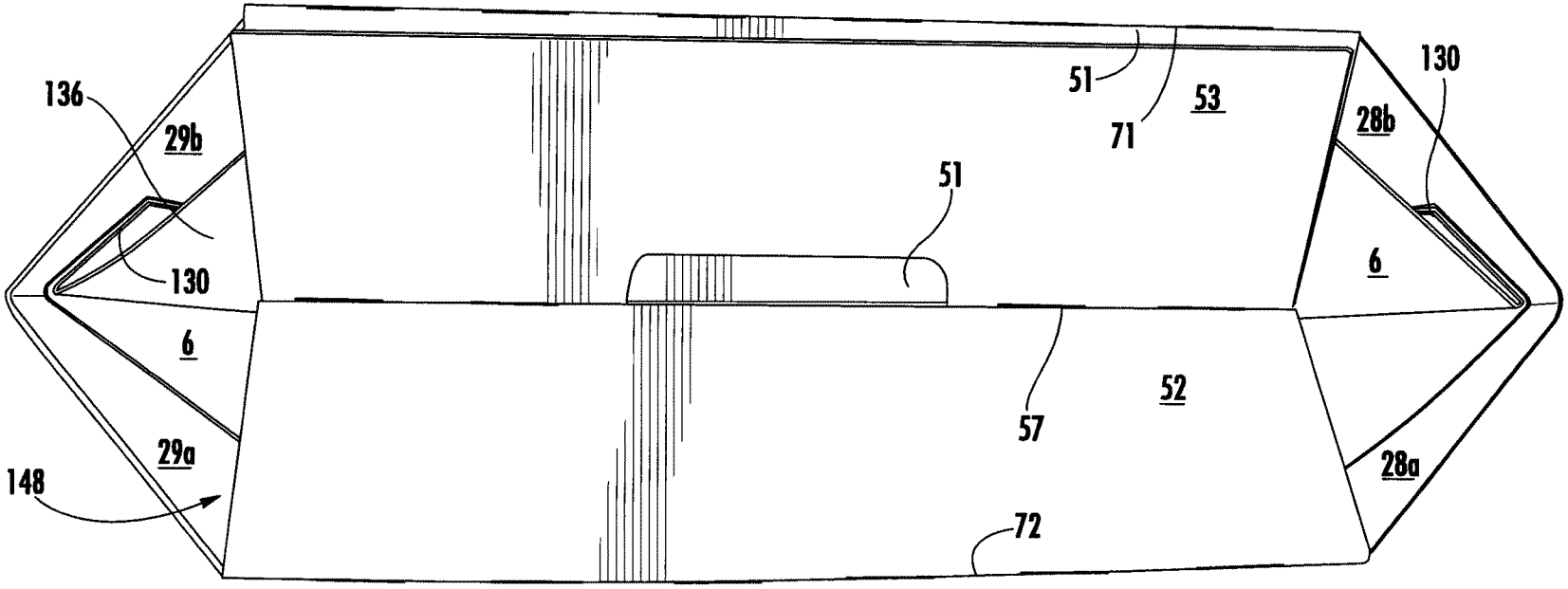

Upon attachment of the reinforcing sleeve 134 to the bag 6, bottom panel 51 may be folded inwardly against the bag 6 as illustrated in FIG. 7. Thereafter, bottom panel 52 and bottom end flap 53 may be folded inwardly against the bottom panel 51 such that the locking tab 55 is brought into locking engagement with the locking notch 54, as illustrated in FIGS. 8-10. According to some embodiments, the bottom end flap 53 may receive adhesive and can be fixedly attached to the bottom panel 51. Alternatively, the bottom end flap 53 can remain free from attachment to the bottom panel 51. Furthermore, the folding sequences described above may be altered or omitted in some embodiments, without departing from the scope of the disclosure.

Figure 11:
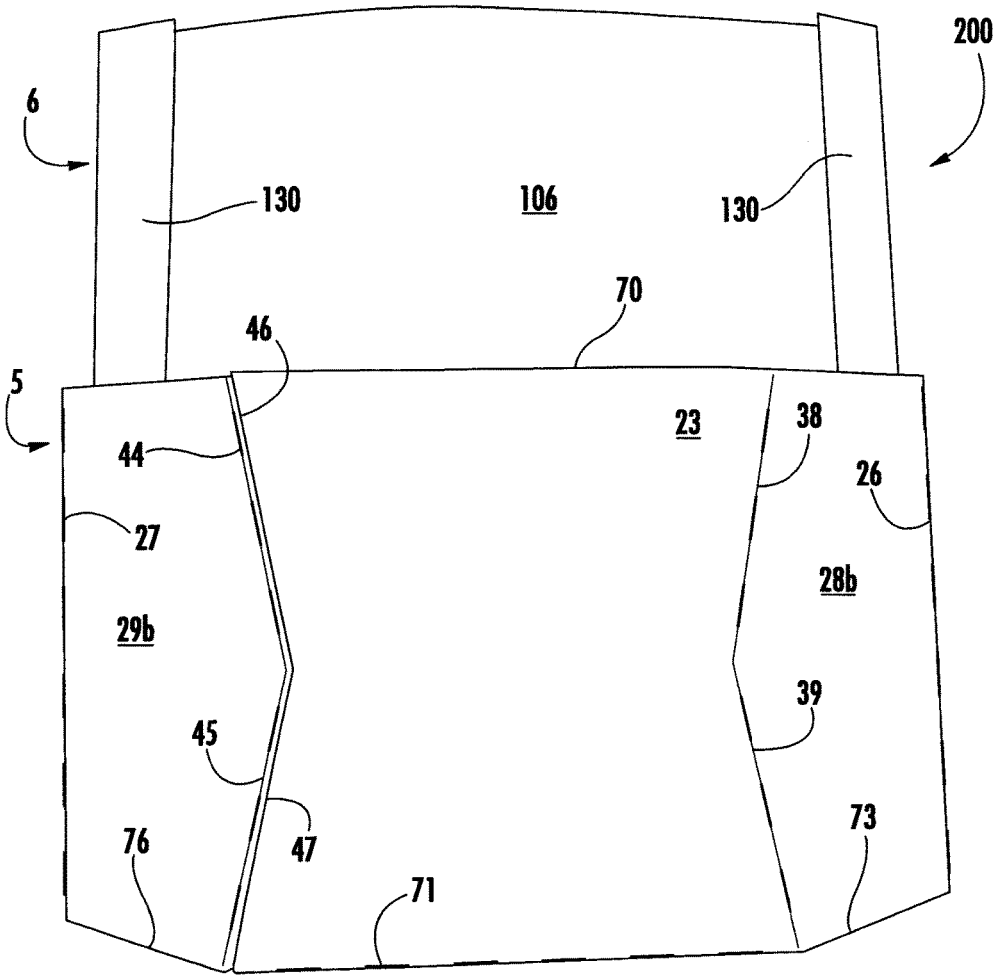
FIG. 11 is a front view of the reinforced package in a non-erected position according to the exemplary embodiment of the disclosure.
Figure 12A:
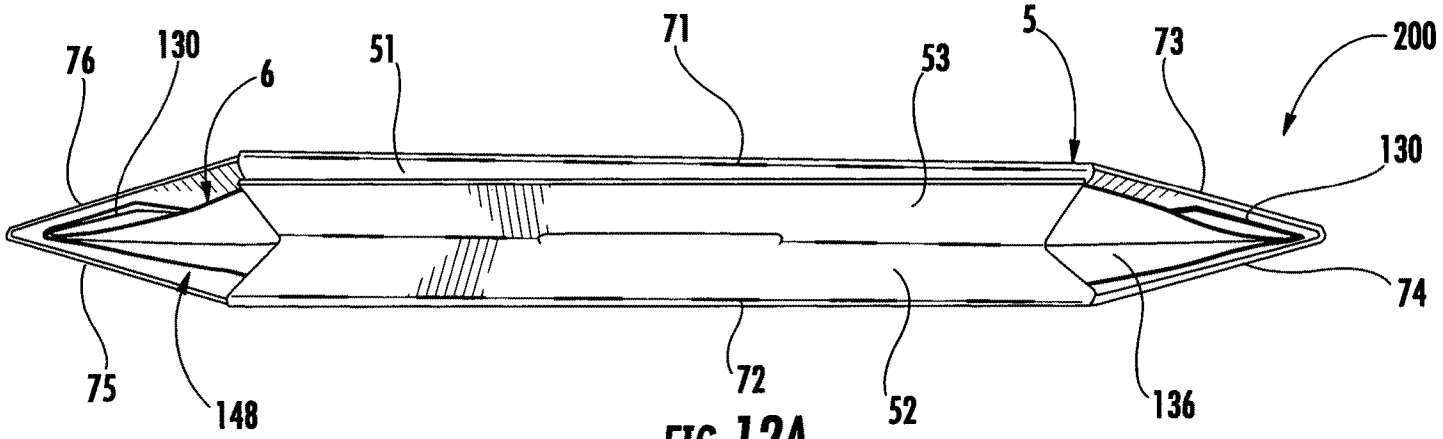
FIGS. 12A and 12B are bottom views of the reinforced package in the non-erected position according to the exemplary embodiment of the disclosure.
Figure 12B:
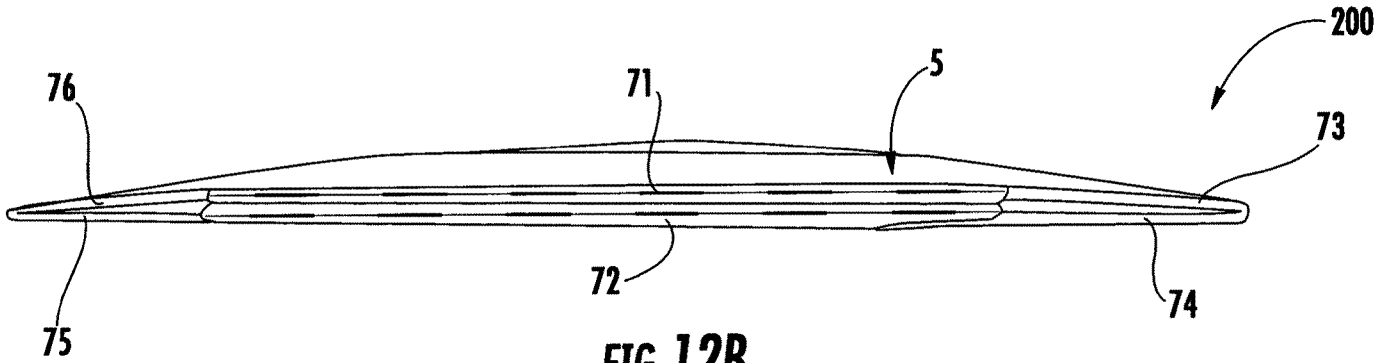
Figure 13:
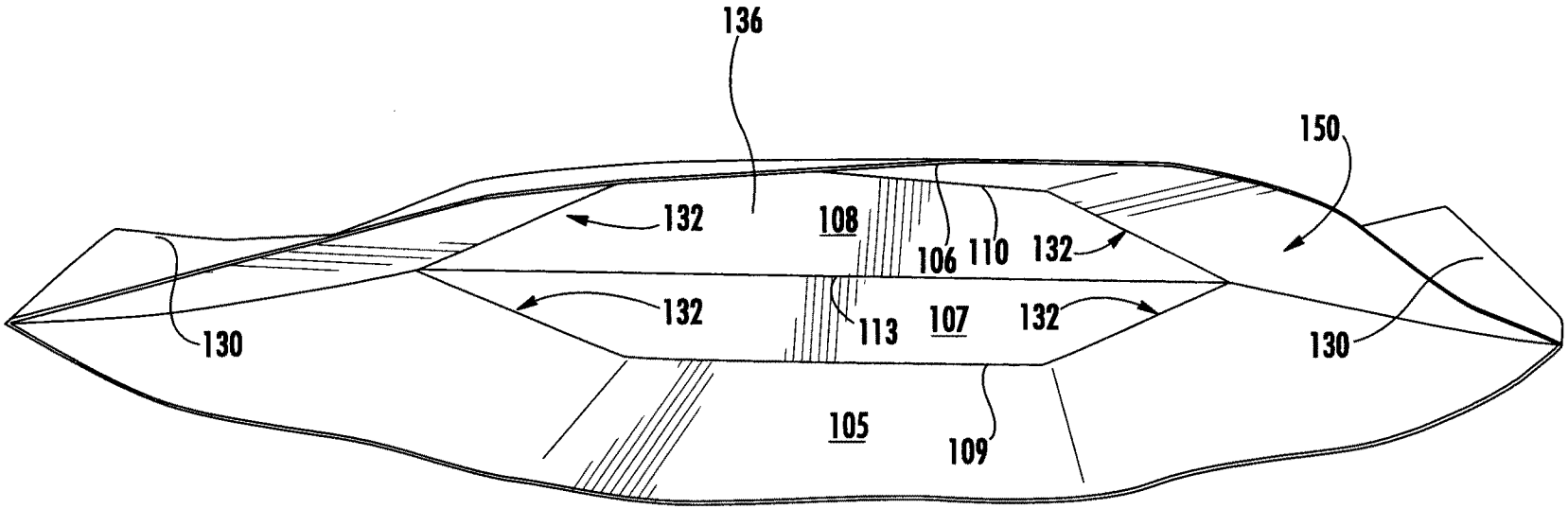
FIG. 13 is a top view of the reinforced package in the non-erected position according to the exemplary embodiment of the disclosure.

Upon folding the bottom panels 51, 52 and bottom end flap 53, a reinforcing carton 5 exists about the bag 6 forming a reinforced package 200. In one embodiment, the bag 6 is glued to an interior surface of the front panel 21 and/or the back panel 23 in an interior 148 of the carton 5. Accordingly, the closed bottom 136 of the bag 6 can be disposed in the interior 148 of the carton 5. In the illustrated embodiment, the package 200 can be in a first, non-erected position or configuration (FIGS. 11-13) or in a second, erected position or configuration (FIGS. 17-20). In the first position, the individual panel portions 28*a*, 28*b*, 29*a*, and 29*b* are folded along the respective lateral fold lines 26, 27 so that the panel portions 28*a*, 29*a* generally oppose the respective panel portions 28*b*, 29*b*. The first, non-erect position illustrated reduces and/or minimizes (e.g., collapses) a volume of an interior space 150 of the bag 6 such that the reinforced package is in a non-erect or semi-flattened state (FIGS. 12A and 13). As shown in FIG. 12B, the carton 5 and bag 6 could be fully or substantially fully flattened in one embodiment. The non-erect state may facilitate easy stacking of a plurality of packages into, for example, a shipment container and subsequent organization at a destination facility. However, as illustrated in FIG. 13, the non-erect state may still facilitate the filling of the interior volume 150 at least partially with a product. Thereafter, the interior volume 150 may be sealed in any feasible manner in one embodiment.

Upon receipt of a reinforced package 200 in the first, non-erect position (with or without a sealed interior volume 150), the individual panel portions 28*a*, 28*b*, 29*a*, and 29*b* may be flexed or positioned to form first and second sides 28, 29 of the package in a second, erect position of the package as illustrated in FIGS. 14-17. Accordingly, in one embodiment, the side panels 28, 29 are pushed inwardly at the respective fold lines 26, 27. The side panel 28 can be folded along fold lines 26, 33, 37 until the panel portions 28*a*, 28*b* are generally coplanar, extending between the front panel 21 and the back panel 23. Similarly, and, in one embodiment, at the same time, the side panel 29 can be folded along fold lines 27, 40, 43 until the panel portions 29*a*, 29*b* are generally coplanar, extending between the front panel 21 and the attachment flap 25 and the back panel 23. Additionally, as the front panel 21 and the back panel 23 move away from one another, the bottom panels 51, 52 can fold along fold lines 71, 72 to be generally coplanar, extending between the front panel and the back panel to form a closed bottom of the carton 5. Further, the sidewalls 105, 106 of the bag 6 are glued to the respective front panel 21 and back panel 23, and the bag can be positioned in the open position by the front and back panels as the side panels 28, 29 are moved inwardly.

In one embodiment, since the side panels 28, 29 are widest between the vertices 30*a*, 30*b* and 31*a*, 31*b*, when the package 200 is in the second, erected position, the side panels 28, 29 can push against the front panel 21 and the back panel 23 at the vertices 30*a*, 30*b* and 31*a*, 31*b*. This can create tension that can help retain the panel portions 28*a*, 28*b* and 29*a*, 29*b* in the generally coplanar position (e.g., can help resist folding of the side panels 28, 29). Additionally, since the front panel 21 and the back panel 23 are widest at the edge 70 and at the lower edges (e.g., fold lines 71, 72), the oblique fold line segments 34, 35, 38, 39 and 41, 42, 44, 48 further can help resist folding of the side panels 28, 29. In one embodiment, the side panels 28, 29 can be generally concave from the exterior of the carton 5 because of the oblique fold line segments of the fold lines 33, 37, 40, 43. Accordingly, the oblique fold line segments 34, 35, 38, 39, 41, 42, 44, 48, the vertices 30*a*, 30*b*, 31*a*, 31*b* and the panel portions 28*a*, 28*b*, 29*a*, 29*b* can cooperate with one another and with the interlocked bottom panels 51, 52 (including the locking tab 55) to form locking features that can help retain the package 200 in the erected configuration. In one embodiment, for example, the locking features can be at least partially disengaged, by pushing outwardly on one or both of the fold lines 26, 27 and moving the front panel 21 and the back panel 23 toward one another. The package 200 can be reconfigured between the non-erected and erected positions using alternative steps and/or features without departing from the disclosure.

Figure 17:
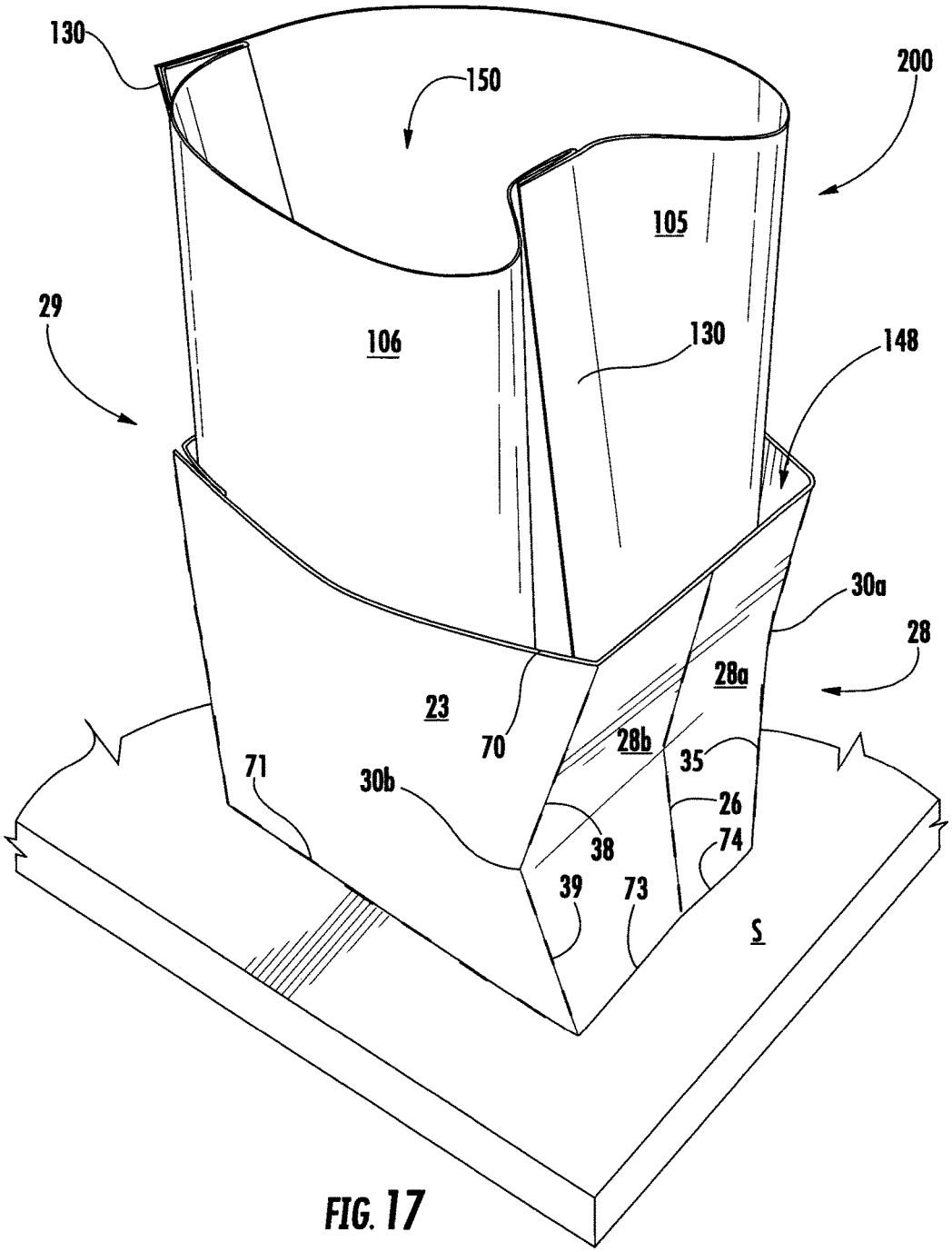
FIG. 17 is a perspective view of the reinforced package in the erected position according to the exemplary embodiment of the disclosure.
Figure 18:
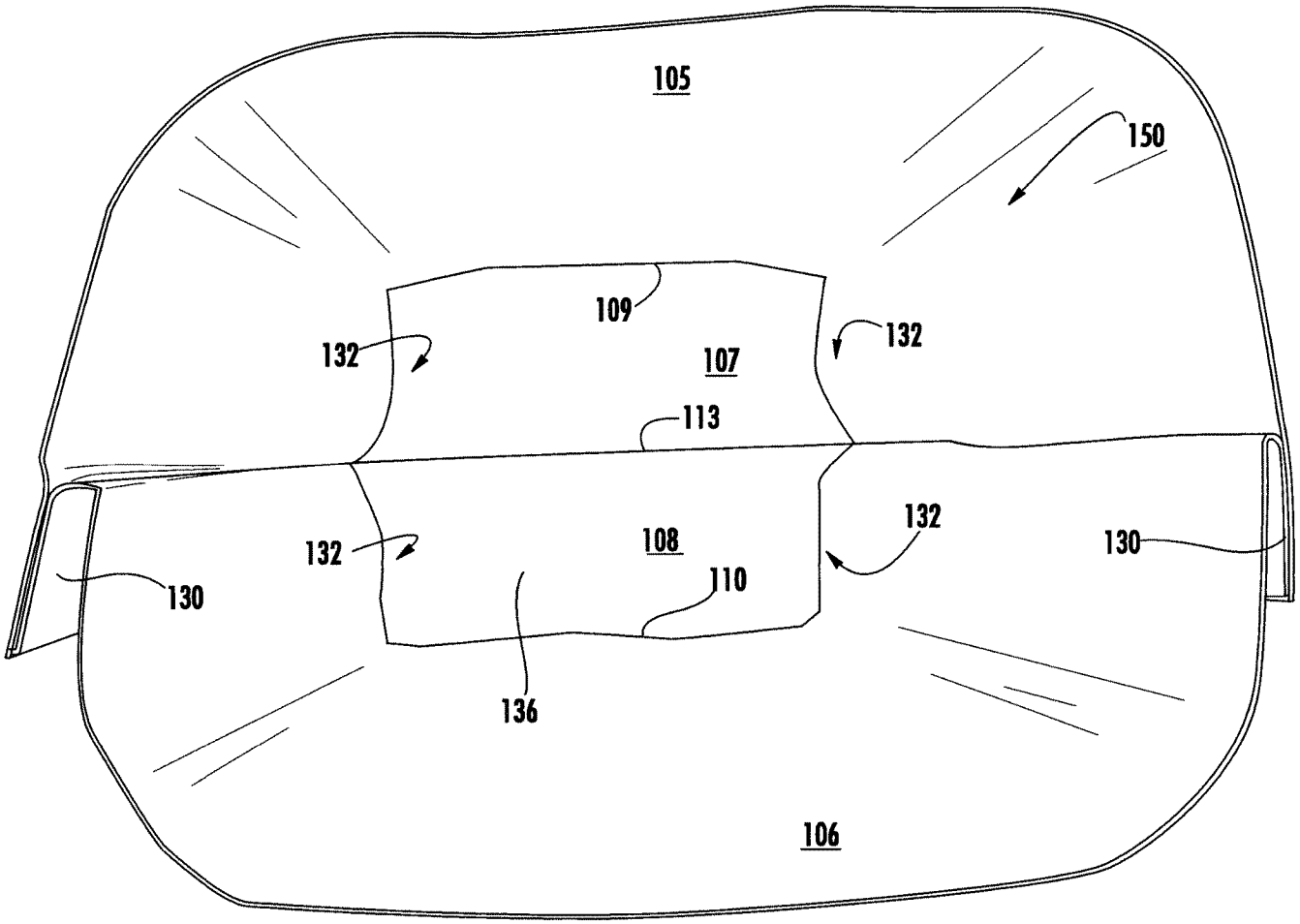
FIG. 18 is a top view of the reinforced package in the erected position according to the exemplary embodiment of the disclosure.
Figure 19:
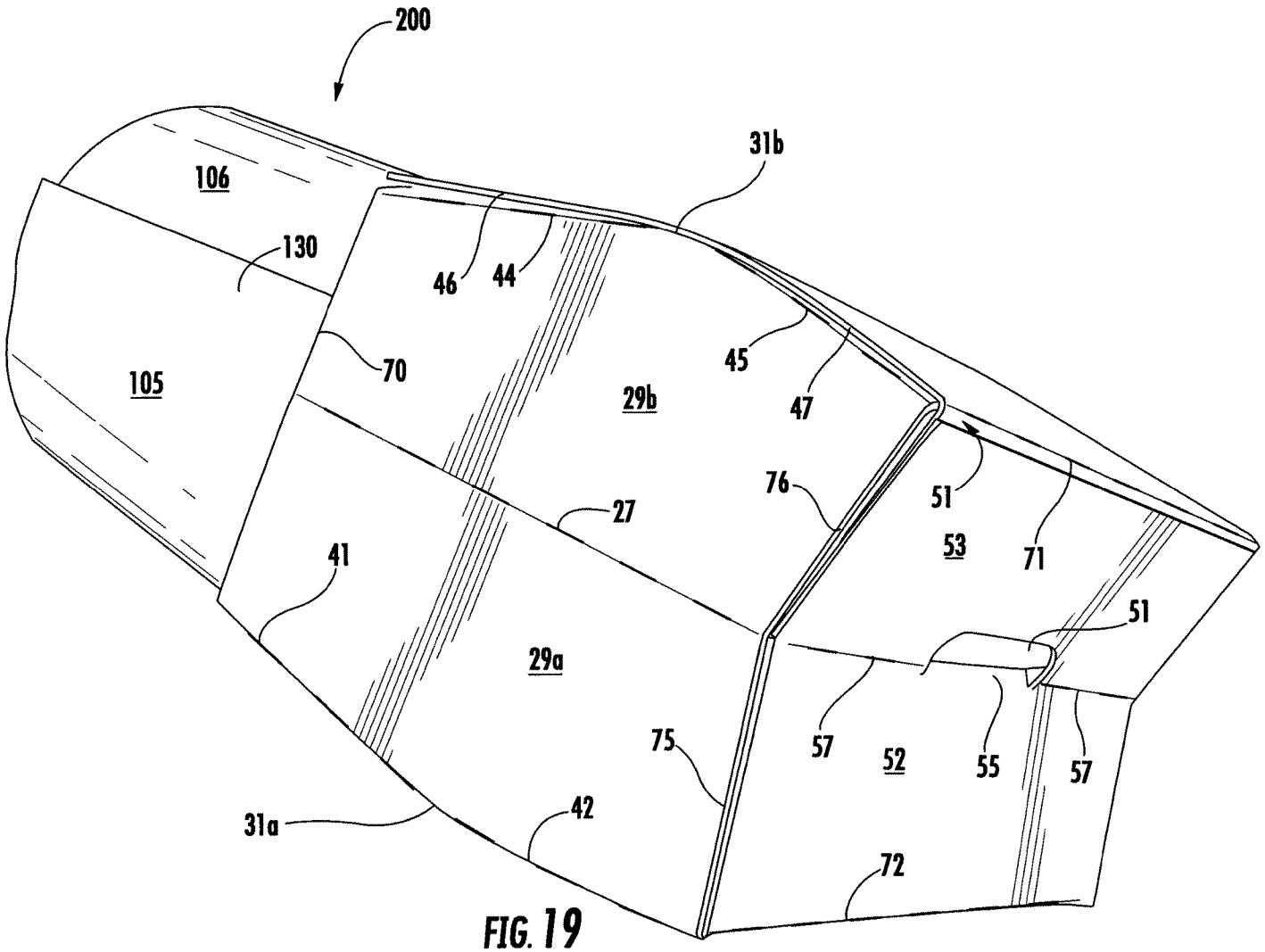
FIGS. 19 and 20 are bottom perspective views of the reinforced package in the erected position according to the exemplary embodiment of the disclosure.
Figure 20:
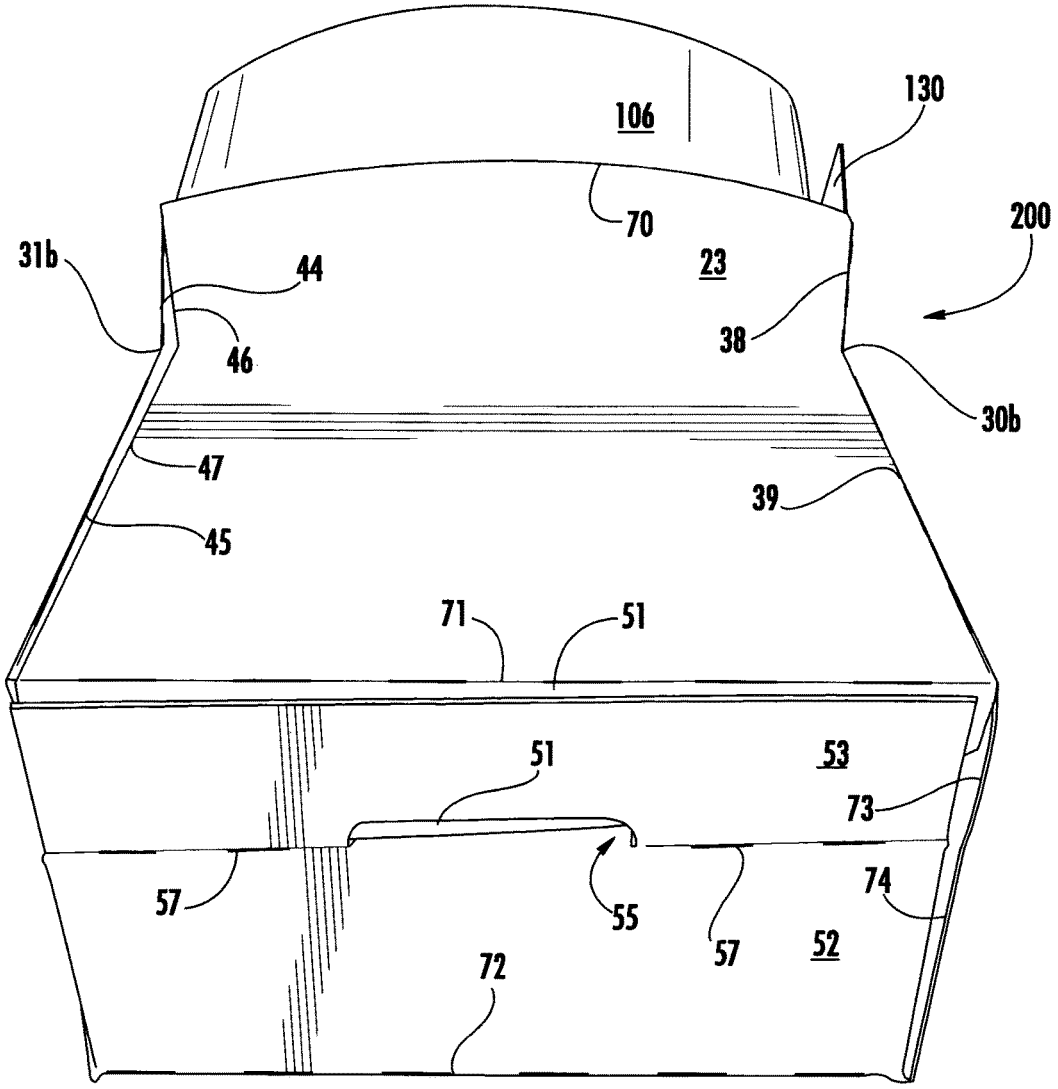

The second, erect position, illustrated in FIG. 17, increases and/or maximizes a volume of the interior space 150 such that the package 200 is in an erect or self-supporting state. Bottom edges 71, 72, 73, 74, 75, 76 can cooperate to form a support when the package 200 is in the erect state for contacting a surface S (e.g., FIG. 17). The support formed of the bottom edges 71, 72 73, 74, 75, 76 (e.g., in a locking interaction due to side panels 28, 29) maintains the package in an upright position on the surface S. Furthermore, due to the impermeable nature of the bag 6, a user may fill the interior volume 150 at least partially with a liquid (e.g., water, heated water, etc.) for rehydrating a product within the volume 150. Moreover, according to some embodiments, the entire package 200 (filled with liquid or not) may be heated in a microwave oven to facilitate cooking and/or rehydrating of the contents of the bag 6. Other intervening states of the package 200 including intermediate states whereby the package is not fully erected are also applicable according to some embodiments. Furthermore, automatically erecting reinforced packages 200 are also applicable, for example, if bag 6 is filled with an expanding food product such as popcorn that expands when heated to move the front panel 21 and the back panel 23 apart to at least partially form side panels 28, 29 during the cooking process.

Generally, as described herein, bags can be formed from a bag stock material, although various plastic or other bag materials also can be used, and can be lined or coated with a desired material. The reinforcing cartons described herein can be made from a more rigid material such as a clay-coated natural kraft ("CCNK"). Other materials such various card-stock, paper, plastic or other synthetic or natural materials also can be used to form the components of the packages described herein.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure without departing from the scope of the disclosure.

What is claimed is:

1. A reinforced package for holding a product, the reinforced package comprising:

a carton comprising a plurality of panels that extend at least partially around an interior of the carton, the plurality of panels comprising a front panel, a first side panel foldably connected to the front panel, a second side panel foldably connected to the front panel, at least one back panel foldably connected to at least one of the first side panel and the second side panel, a first bottom panel foldably connected to the back panel, and a second bottom panel foldably connected to the front panel;

a bag comprising an at least partially open end, an at least partially closed end, and an interior space for holding a product, the bag being at least partially received in the interior of the carton, wherein the bag comprises a first sidewall and a second sidewall, and the at least partially closed end of the bag comprises a first gusset panel foldably connected to a second gusset panel along a first fold line, the first sidewall is foldably connected to the first gusset panel along a second fold line, and the second sidewall is foldably connected to the second gusset panel along a third fold line;

wherein the carton is positionable in a non-erect position wherein the interior space of the bag is at least partially collapsed and the first gusset panel and the second gusset panel are at least partially folded with respect to one another and in an erect position wherein the interior space of the bag is increased and the first gusset panel and the second gusset panel are expanded, and the carton is configured to support the bag in the erect position;

wherein the first bottom panel and the second bottom panel at least partially overlap one another in the interior of the carton when the carton is in the non-erect position.

2. The reinforced package of claim 1, wherein the at least partially closed end of the bag is at least partially received in the interior of the carton.

3. The reinforced package of claim 1, wherein the bag is at least partially glued to an interior surface of at least one of the front panel and the back panel.

4. The reinforced package of claim 3, wherein at least one of the first sidewall and the second sidewall of the bag is glued to the interior surface of the at least one of the front panel and the back panel.

5. The reinforced package of claim 1, wherein each of the first sidewall and the second sidewall of the bag extends generally upwardly from the at least partially closed end of the bag.

6. The reinforced package of claim 5, wherein the first sidewall and the second sidewall are attached to one another by at least one seam extending along a marginal area of the bag.

7. The reinforced package of claim 6, wherein the at least one seam comprises at least a first seam and a second seam, the first seam and the second seam extending along respective marginal areas of the bag.

8. The reinforced package of claim 6, wherein the at least one seam comprises at least one glue area extending along each of the first sidewall and the second sidewall, and respective portions of the at least one glue area in the first sidewall and the second sidewall are at least partially glued in face-to-face contact.

9. The reinforced package of claim 8, wherein the at least one glue area further extends along at least a portion of the at least partially closed end of the bag, at least a portion of the at least one glue area in the at least partially closed end being at least partially glued to another portion of the at least one glue area in the at least partially closed end to form at least one sealed corner of the bag.

10. The reinforced package of claim 9, wherein the at least one seam comprises at least a first seam and a second seam, the at least one glue area comprises at least a first glue area and a second glue area, and the at least one sealed corner comprises a first sealed corner and a second sealed corner.

11. The reinforced package of claim 5, wherein the first gusset panel and the second gusset panel are generally coplanar with each other when the carton is in the erect position and are at least partially folded with respect to one another along the first fold line when the carton is in the non-erect position.

12. The reinforced package of claim 11, wherein the first gusset panel and the second gusset panel are disposed generally between the first sidewall and the second sidewall when the carton is in the non-erect position.

13. The reinforced package of claim 1, wherein the first side panel comprises a first panel portion foldably connected to a second panel portion along a first lateral fold line, and the second side panel comprises a third panel portion foldably connected to a fourth panel portion along a second lateral fold line.

14. The reinforced package of claim 13, wherein the first panel portion and the third panel portion are generally coplanar with the respective second panel portion and fourth panel portion when the carton is in the erect position, and the first side panel and the second side panel are folded along the respective first lateral fold line and second lateral fold line so that the first panel portion generally opposes the second panel portion and the third panel portion generally opposes the fourth panel portion when the carton is in the non-erect position.

15. The reinforced package of claim 14, wherein the first side panel is foldably connected to the front panel along a first fold line and to the back panel along a second fold line, the second side panel is foldably connected to the front panel along a third fold line and to an attachment flap along a fourth fold line, the attachment flap is at least partially attached to the back panel, and each of the first fold line, the second fold line, the third fold line, and the fourth fold line comprises a first oblique portion extending from a second oblique portion so that each of the front panel and the back panel is widest at respective upper and lower edges.

16. The reinforced package of claim 1, wherein the first side panel comprises a first panel portion foldably connected to a second panel portion along a first fold line, the first panel portion is foldably connected to the front panel along a second fold line, and the second panel portion is foldably connected to the back panel along a third fold line.

17. The reinforced package of claim 16, wherein each of the second fold line and the third fold line comprises a first oblique portion extending from a second oblique portion at a vertex, each vertex being spaced apart from the first fold line so that each of the first panel portion and the second panel portion is widest adjacent the respective vertex.

18. The reinforced package of claim 1, wherein the first gusset panel and the second gusset panel are generally coplanar when the carton is in the erect position and are folded to be at least partially in face-to-face contact with one another when the carton is in the non-erect position.

19. The reinforced package of claim 1, wherein each of the first bottom panel and the second bottom panel is free from connection to each of the first side panel and the second side panel.

20. The reinforced package of claim 1, wherein the front panel, the back panel, the first bottom panel, and the second bottom panel at least partially overlap one another when the carton is in the non-erect position.

21. A reinforced package for holding a product, the reinforced package comprising:

a carton comprising a plurality of panels that extend at least partially around an interior of the carton, the plurality of panels comprising a front panel, a first side panel foldably connected to the front panel, a second side panel foldably connected to the front panel, at least one back panel foldably connected to at least one of the first side panel and the second side panel, and at least one bottom panel foldably connected to at least one of the front panel and the back panel;

a bag comprising an at least partially open end, an at least partially closed end, and an interior space for holding a product, the bag being at least partially received in the interior of the carton, wherein the bag comprises a first sidewall and a second sidewall, and the at least partially closed end of the bag comprises a first gusset panel foldably connected to a second gusset panel along a first fold line, the first sidewall is foldably connected to the first gusset panel along a second fold line, and the second sidewall is foldably connected to the second gusset panel along a third fold line;

wherein the carton is positionable in a non-erect position wherein the interior space of the bag is at least partially collapsed and the first gusset panel and the second gusset panel are at least partially folded with respect to one another and in an erect position wherein the interior space of the bag is increased and the first gusset panel and the second gusset panel are expanded, and the carton is configured to support the bag in the erect position;

wherein the at least one bottom panel comprises a first bottom panel foldably connected to the back panel and a second bottom panel foldably connected to the front panel, and a locking tab extending from the second bottom panel and engageable with a locking notch formed into an edge of the first bottom panel prior to expanding the carton from the non-erect position to the erect position.

22. The reinforced package of claim 21, further comprising a bottom flap foldably connected to the second bottom panel along a fold line that is at least partially interrupted by the locking tab, and the locking tab is at least partially defined by a cut line in the bottom flap, wherein a distance between the locking tab and the fold line between the second bottom panel and the front panel is substantially equal to the distance between the locking notch and the fold line between the first bottom panel and the back panel, such that a line of engagement between the locking notch and the base of the locking tab is substantially centered between the front panel and the back panel.

23. A reinforcing carton for holding a product, the reinforcing carton comprising:

a plurality of panels that extend at least partially around an interior of the carton, the plurality of panels comprising a front panel, a first side panel foldably connected to the front panel along a first fold line, a second side panel foldably connected to the front panel along a second fold line, a back panel foldably connected to the first side panel along a third fold line, an attachment flap foldably connected to the second side panel along a fourth fold line, a first bottom panel foldably connected to the back panel, and a second bottom panel foldably connected to the front panel, wherein the attachment flap is at least partially attached to the back panel, and each of the first fold line, the second fold line, the third fold line, and the fourth fold line comprises a first oblique portion extending from a second oblique portion so that each of the front panel and the back panel is widest at respective upper and lower edges, each of the first oblique portions and the second oblique portions being generally straight; and locking features in at least one panel of the plurality of panels, the locking features being operable to at least partially retain the reinforcing carton in an erect position and for allowing the plurality of panels to at least partially collapse into an non-erect position of the reinforcing carton, wherein the locking features comprise the first oblique portions and the second oblique portions of each of the first fold line, the second fold line, the third fold line, and the fourth fold line;

wherein the first bottom panel and the second bottom panel at least partially overlap one another in the interior of the carton when the carton is in the non-erect position.

24. The reinforcing carton of claim 23, wherein the first side panel comprises a first panel portion foldably connected to a second panel portion along a first lateral fold line, and the second side panel comprises a third panel portion foldably connected to a fourth panel portion along a second lateral fold line.

25. The reinforcing carton of claim 24, wherein the first panel portion and the third panel portion are generally coplanar with the respective second panel portion and fourth panel portion when the carton is in the erect position, and the first side panel and the second side panel are folded along the respective first lateral fold line and second lateral fold line so that the first panel portion generally opposes the second panel portion and the third panel portion generally opposes the fourth panel portion when the carton is in the non-erect position.

26. The reinforcing carton of claim 23, wherein the first side panel comprises a first panel portion foldably connected to a second panel portion along a lateral fold line, the first panel portion is foldably connected to the front panel along the first fold line, and the second panel portion is foldably connected to the back panel along the third fold line.

27. The reinforcing carton of claim 26, wherein the first oblique portion extends from the respective second oblique portion at a respective vertex in each of at least the first fold line and the third fold line, each vertex being spaced apart from the lateral fold line so that each of the first panel portion and the second panel portion is widest adjacent the respective vertex.

28. The reinforcing carton of claim 23, wherein each of the first bottom panel and the second bottom panel is free from connection to each of the first side panel and the second side panel.

29. The reinforcing carton of claim 23, wherein the front panel, the back panel, the first bottom panel, and the second bottom panel at least partially overlap one another when the carton is in the non-erect position.

30. A reinforcing carton for holding a product, the reinforcing carton comprising:

a plurality of panels that extend at least partially around an interior of the carton, the plurality of panels comprising a front panel, a first side panel foldably connected to the front panel along a first fold line, a second side panel foldably connected to the front panel along a second fold line, a back panel foldably connected to the first side panel along a third fold line, an attachment flap foldably connected to the second side panel along a fourth fold line, and at least one bottom panel foldably connected to at least one of the front panel and the back panel, wherein the attachment flap is at least partially attached to the back panel, and each of the first fold line, the second fold line, the third fold line, and the fourth fold line comprises a first oblique portion extending from a second oblique portion so that each of the front panel and the back panel is widest at respective upper and lower edges, each of the first oblique portions and the second oblique portions being generally straight; and locking features in at least one panel of the plurality of panels, the locking features being operable to at least partially retain the reinforcing carton in an erect position and for allowing the plurality of panels to at least partially collapse into an non-erect position of the reinforcing carton, wherein the locking features comprise the first oblique portions and the second oblique portions of each of the first fold line, the second fold line, the third fold line, and the fourth fold line;

wherein the at least one bottom panel comprises a first bottom panel foldably connected to the back panel and a second bottom panel foldably connected to the front panel, and the locking features further comprise a locking tab extending from the second bottom panel and engageable with a locking notch formed into an edge of the first bottom panel prior to expanding the carton from the non-erect position to the erect position.

31. The reinforcing carton of claim 30, further comprising a bottom flap foldably connected to the second bottom panel along a fold line that is at least partially interrupted by the locking tab, and the locking tab is at least partially defined by a cut line in the bottom flap, wherein a distance between the locking tab and the fold line between the second bottom panel and the front panel is substantially equal to the distance between the locking notch and the fold line between the first bottom panel and the back panel, such that a line of engagement between the locking notch and the base of the locking tab is substantially centered between the front panel and the back panel.

32. In combination, a carton blank and a bag for forming a reinforced package for holding a product:

the carton blank being for forming a carton, the carton blank comprising a plurality of panels comprising a front panel, a first side panel foldably connected to the front panel, a second side panel foldably connected to the front panel, at least one back panel foldably connected to at least one of the first side panel and the second side panel, a first bottom panel foldably connected to the back panel, and a second bottom panel foldably connected to the front panel;

a bag comprising an at least partially open end, an at least partially closed end, and an interior space for holding a product, the bag being at least partially attached to the carton blank, wherein the bag comprises a first sidewall and a second sidewall, and the at least partially closed end of the bag comprises a first gusset panel foldably connected to a second gusset panel along a first fold line, the first sidewall is foldably connected to the first gusset panel along a second fold line, and the second sidewall is foldably connected to the second gusset panel along a third fold line;

wherein the reinforced package formed from the carton blank and the bag is positionable in a non-erect position wherein the interior space of the bag is at least partially collapsed and the first gusset panel and the second gusset panel are at least partially folded with respect to one another and in an erect position wherein the interior space of the bag is increased and the first gusset panel and the second gusset panel are expanded;

wherein the first bottom panel and the second bottom panel are for being at least partially overlapped with respect to one another in an interior of the carton formed from the carton blank when the carton is in the non-erect position.

33. The combination of claim 32, wherein the at least partially closed end of the bag is disposed adjacent at least one of the front panel and the back panel of the carton blank for being at least partially received in the interior of the carton formed from the carton blank.

34. The combination of claim 32, wherein the bag is at least partially glued to an interior surface of at least one of the front panel and the back panel.

35. The combination of claim 34, wherein at least one of the first sidewall and the second sidewall of the bag is glued to the interior surface of the at least one of the front panel and the back panel.

36. The combination of claim 32, wherein each of the first sidewall and the second sidewall of the bag extends generally upwardly from the at least partially closed end of the bag.

37. The combination of claim 36, wherein the first sidewall and the second sidewall are attached to one another by at least one seam extending along a marginal area of the bag.

38. The combination of claim 37, wherein the at least one seam comprises at least a first seam and a second seam, the first seam and the second seam extending along respective marginal areas of the bag.

39. The combination of claim 37, wherein the at least one seam comprises at least one glue area extending along each of the first sidewall and the second sidewall, and respective portions of the at least one glue area in the first sidewall and the second sidewall are at least partially glued in face-to-face contact.

40. The combination of claim 39, wherein the at least one glue area further extends along at least a portion of the at least partially closed end of the bag, at least a portion of the at least one glue area in the at least partially closed end being at least partially glued to another portion of the at least one glue area in the at least partially closed end to form at least one sealed corner of the bag.

41. The combination of claim 40, wherein the at least one seam comprises at least a first seam and a second seam, the at least one glue area comprises at least a first glue area and a second glue area, and the at least one sealed corner comprises a first sealed corner and a second sealed corner.

42. The combination of claim 36, wherein the first gusset panel and the second gusset panel are for being generally coplanar with each other when the reinforced package formed from the carton blank and the bag is in the erect position and are for being at least partially folded with respect to one another along the first fold line when the reinforced package formed from the carton blank and the bag is in the non-erect position.

43. The combination of claim 42, wherein the first gusset panel and the second gusset panel are disposed generally between the first sidewall and the second sidewall.

44. The combination of claim 32, wherein the first side panel comprises a first panel portion foldably connected to a second panel portion along a first lateral fold line, and the second side panel comprises a third panel portion foldably connected to a fourth panel portion along a second lateral fold line.

45. The combination of claim 44, wherein the first side panel is foldably connected to the front panel along a first fold line and to the back panel along a second fold line, the second side panel is foldably connected to the front panel along a third fold line and to an attachment flap along a fourth fold line, the attachment flap is for being at least partially attached to the back panel, and each of the first fold line, the second fold line, the third fold line, and the fourth fold line comprises a first oblique portion extending from a second oblique portion so that each of the front panel and the back panel is widest at respective upper and lower edges.

46. The combination of claim 32, wherein the first side panel comprises a first panel portion foldably connected to a second panel portion along a first fold line, the first panel portion is foldably connected to the front panel along a second fold line, and the second panel portion is foldably connected to the back panel along a third fold line.

47. The combination of claim 46, wherein each of the second fold line and the third fold line comprises a first oblique portion extending from a second oblique portion at a vertex, each vertex being spaced apart from the first fold line so that each of the first panel portion and the second panel portion is widest adjacent the respective vertex.

48. The combination of claim 32, wherein the first gusset panel and the second gusset panel are generally coplanar when the carton formed from the carton blank is in the erect position and are folded to be at least partially in face-to-face contact with one another when the carton formed from the carton blank is in the non-erect position.

49. The combination of claim 32, wherein each of the first bottom panel and the second bottom panel is free from connection to each of the first side panel and the second side panel.

50. In combination, a carton blank and a bag for forming a reinforced package for holding a product:

the carton blank being for forming a carton, the carton blank comprising a plurality of panels comprising a front panel, a first side panel foldably connected to the front panel, a second side panel foldably connected to the front panel, at least one back panel foldably connected to at least one of the first side panel and the second side panel, and at least one bottom panel foldably connected to at least one of the front panel and the back panel;

a bag comprising an at least partially open end, an at least partially closed end, and an interior space for holding a product, the bag being at least partially attached to the carton blank, wherein the bag comprises a first sidewall and a second sidewall, and the at least partially closed end of the bag comprises a first gusset panel foldably connected to a second gusset panel along a first fold line, the first sidewall is foldably connected to the first gusset panel along a second fold line, and the second sidewall is foldably connected to the second gusset panel along a third fold line;

wherein the reinforced package formed from the carton blank and the bag is positionable in a non-erect position wherein the interior space of the bag is at least partially collapsed and the first gusset panel and the second gusset panel are at least partially folded with respect to one another and in an erect position wherein the interior space of the bag is increased and the first gusset panel and the second gusset panel are expanded;

wherein the at least one bottom panel comprises a first bottom panel foldably connected to the back panel and a second bottom panel foldably connected to the front panel, and a locking tab extending from the second bottom panel for at least partially engaging a locking notch formed into an edge of the first bottom panel when the reinforced package is formed from the carton blank and the bag and prior to expanding the carton from the non-erect position to the erect position.

51. The combination of claim 50, further comprising a bottom flap foldably connected to the second bottom panel along a fold line that is at least partially interrupted by the locking tab, and the locking tab is at least partially defined by a cut line in the bottom flap, wherein a distance between the locking tab and the fold line between the second bottom panel and the front panel is substantially equal to the distance between the locking notch and the fold line between the first bottom panel and the back panel, such that a line of engagement between the locking notch and the base of the locking tab is substantially centered between the front panel and the back panel.

52. A method for forming a reinforced package for holding a product, the method comprising:

obtaining a carton blank comprising a plurality of panels comprising a front panel, a first side panel foldably connected to the front panel, a second side panel foldably connected to the front panel, at least one back panel foldably connected to at least one of the first side panel and the second side panel, a first bottom panel foldably connected to the back panel, and a second bottom panel foldably connected to the front panel;

obtaining a liner blank;

forming a bag from the liner blank so that the bag comprises an at least partially open end, an at least partially closed end, a first sidewall, a second sidewall, and an interior space for holding a product, wherein the at least partially closed end of the bag comprises a first gusset panel foldably connected to a second gusset panel along a first fold line, the first sidewall is foldably connected to the first gusset panel along a second fold line, and the second sidewall is foldably connected to the second gusset panel along a third fold line;

attaching at least a portion of the bag to at least one of the front panel and the back panel of the carton blank; and forming an interior of a carton at least partially defined by the plurality of panels, the forming the interior of the carton comprising forming an open-ended sleeve;

wherein the carton is positionable in a non-erect position wherein the interior space of the bag is at least partially collapsed and the first gusset panel and the second gusset panel are at least partially folded with respect to one another and in an erect position wherein the interior space of the bag is increased and the first gusset panel and the second gusset panel are expanded, and the carton is configured to support the bag in the erect position;

wherein the first bottom panel and the second bottom panel at least partially overlap one another in the interior of the carton when the carton is in the non-erect position.

53. The method of claim 52, wherein the forming the bag comprising attaching the first sidewall to the second sidewall at at least one seam along a marginal area of the bag so that each of the first sidewall and the second sidewall extends generally upwardly from the at least partially closed end of the bag.

54. The method of claim 53, wherein the at least one seam comprises at least one glue area extending along each of the first sidewall and the second sidewall, and the attaching the first sidewall to the second sidewall comprising gluing respective portions of the at least one glue area in the first sidewall and the second sidewall in face-to-face contact.

55. The method of claim 54, wherein the at least one glue area further extends along at least a portion of the at least partially closed end of the bag, the gluing the respective portions of the at least one glue area comprising gluing at least a portion of the at least one glue area in the at least partially closed end to another portion of the at least one glue area in the at least partially closed end to form at least one sealed corner of the bag.

56. The method of claim 52, wherein:

the first side panel comprises a first panel portion foldably connected to a second panel portion along a first lateral fold line, and the second side panel comprises a third panel portion foldably connected to a fourth panel portion along a second lateral fold line;

the first side panel is foldably connected to the front panel along a first fold line and to the back panel along a second fold line, the second side panel is foldably connected to the front panel along a third fold line and to an attachment flap along a fourth fold line; and the forming the interior of the carton comprising folding the first side panel and the second side panel along the respective first lateral fold line and second lateral fold line and at least partially overlapping the back panel and the attachment flap.

57. The method of claim 56, wherein each of the first fold line, the second fold line, the third fold line, and the fourth fold line comprises a first oblique portion extending from a second oblique portion at a vertex, each vertex being spaced apart from the respective first fold line and second fold line so that each of the first side panel and the second side panel is widest adjacent the respective vertices.

58. The method of claim 52, wherein the first gusset panel and the second gusset panel are generally coplanar when the carton is in the erect position and are folded to be at least partially in face-to-face contact with one another when the carton is in the non-erect position.

59. The method of claim 52, wherein each of the first bottom panel and the second bottom panel is free from connection to each of the first side panel and the second side panel.

60. The method of claim 52, wherein the front panel, the back panel, the first bottom panel, and the second bottom panel at least partially overlap one another when the carton is in the non-erect position.

61. A method for forming a reinforced package for holding a product, the method comprising:

obtaining a carton blank comprising a plurality of panels comprising a front panel, a first side panel foldably connected to the front panel, a second side panel foldably connected to the front panel, at least one back panel foldably connected to at least one of the first side panel and the second side panel, and at least one bottom panel foldably connected to at least one of the front panel and the back panel, wherein the at least one bottom panel comprises a first bottom panel foldably connected to the back panel and a second bottom panel foldably connected to the front panel, a locking tab extending from the second bottom panel and engageable with a locking notch formed into an edge of the first bottom panel;

obtaining a liner blank;

forming a bag from the liner blank so that the bag comprises an at least partially open end, an at least partially closed end, a first sidewall, a second sidewall, and an interior space for holding a product, wherein the at least partially closed end of the bag comprises a first gusset panel foldably connected to a second gusset panel along a first fold line, the first sidewall is foldably connected to the first gusset panel along a second fold line, and the second sidewall is foldably connected to the second gusset panel along a third fold line;

attaching at least a portion of the bag to at least one of the front panel and the back panel of the carton blank;

forming an interior of a carton at least partially defined by the plurality of panels, the forming the interior of the carton comprising forming an open-ended sleeve;

wherein the carton is positionable in a non-erect position wherein the interior space of the bag is at least partially collapsed and the first gusset panel and the second gusset panel are at least partially folded with respect to one another and in an erect position wherein the interior space of the bag is increased and the first gusset panel and the second gusset panel are expanded, and the carton is configured to support the bag in the erect position; and forming an at least partially closed end of the carton by at least partially engaging the locking tab with the locking notch of the first bottom panel prior to expanding the carton from the non-erect position to the erect position.

62. The method of claim 61, wherein the carton blank further comprises a bottom flap foldably connected to the second bottom panel along a fold line that is at least partially interrupted by the locking tab, and the locking tab is at least partially defined by a cut line in the bottom flap, wherein a distance between the locking tab and the fold line between the second bottom panel and the front panel is substantially equal to the distance between the locking notch and the fold line between the first bottom panel and the back panel, such that a line of engagement between the locking notch and the base of the locking tab is substantially centered between the front panel and the back panel.

* * * * *